United States Patent [19]

Kohtani et al.

[11] Patent Number: 4,937,624

[45] Date of Patent: Jun. 26, 1990

[54] DEVICE FOR STORING DEVELOPING UNITS

[75] Inventors: Hideto Kohtani; Tadashi Suzuki, both of Yokohama; Naoyuki Ohki, Tokyo; Isamu Sato; Takahiro Ushiro, both of Yokohama, all of Japan

[73] Assignee: Canon Kabushiki Kaisha, Tokyo, Japan

[21] Appl. No.: 345,172

[22] Filed: May 1, 1989

[30] Foreign Application Priority Data

May 2, 1988 [JP] Japan ..... 63-107650
May 6, 1988 [JP] Japan ..... 63-109076

[51] Int. Cl.[5] ..... G03G 15/01; G03G 21/00
[52] U.S. Cl. ..... 355/245; 355/326
[58] Field of Search ..... 355/245, 251, 252, 259, 355/260, 326, 327, 328, 256; 118/645, 653, 656, 657, 658, 661

[56] References Cited

U.S. PATENT DOCUMENTS 4,841,329 6/1989 Kasamura et al. ..... 355/245
4,841,336 6/1989 Kusumoto et al. ..... 355/245

*Primary Examiner*—R. L. Moses
*Attorney, Agent, or Firm*—Fitzpatrick, Cella, Harper & Scinto

[57] ABSTRACT

A developing unit storage device includes a plurality of storage cases for storing developing units, a taking in portion for taking in the developing unit from a corresponding one of the storage case into an image forming apparatus, a first moving mechanism for moving the developing unit in a first direction between the storage case and the image forming apparatus, a second moving mechanism for moving the storage case in a second direction different from the first direction so that a desired one of the storage case is adjusted to the taking in portion, and a control unit for inhibiting the first and second moving mechanism from operating at the same time.

34 Claims, 19 Drawing Sheets

DEVICE FOR STORING DEVELOPING UNITS

BACKGROUND OF THE INVENTION

The present invention relates to a device for storing a plurality of developing units used in a copying machine, a printer, or the like.

Some image forming apparatuses of this type comprise a plurality of developing units, and switch these developing units by a rotary mechanism.

Another apparatus is proposed wherein a plurality of developing units are equipped in a storage device outside a main body. In this case, a moving operation is required to replace a developing unit inside the main body with a developing unit inside the storage device, or to move a developing unit inside the storage device into the main body.

In order to perform the above moving operation, the developing units must be moved in two directions in the storage device. During movement of a developing unit in one direction, a moving mechanism for the other direction may be operated, and as a result, the developing unit may be stopped at an abnormal position or the storage device or the developing unit may be broken by forcible movement.

In order to perform the above moving operation, a storage case for storing a developing unit is moved inside the storage device, and its storage portion must be precisely stopped at a developing unit taking out/in portion facing a developing unit taking out/in port of the main body.

However, a load acting on a mechanism for moving the storage case varies depending on the number of developing units stored in the developing unit storage device. If control is made in correspondence with a maximum number of developing units, when the number of developing units is small, stopping precision of the moving mechanism is impaired. If the moving mechanism is modified in order to improve the stopping precision, the mechanism becomes complicated and expensive.

SUMMARY OF THE INVENTION

The present invention has been made in consideration of the above situation, and has as its object to provide an improved device for storing a developing unit.

It is another object of the present invention to provide a device for storing a plurality of developing units, which can prevent an erroneous operation during movement of the developing units.

It is still another object of the present invention to provide a device for storing a developing unit, which can prevent the developing unit from being stopped at an abnormal position.

It is still another object of the present invention to provide a device for storing a plurality of developing units, which can prevent the developing unit from being broken by forcible movement.

It is still another object of the present invention to provide a device for storing a developing unit, which can precisely align the developing unit.

The above and other objects will be apparent from the following description taken in conjunction with the accompanying drawings.

DETAILED DESCRIPTION OF THE PREFERRED EMBODIMENTS

Figure 15:
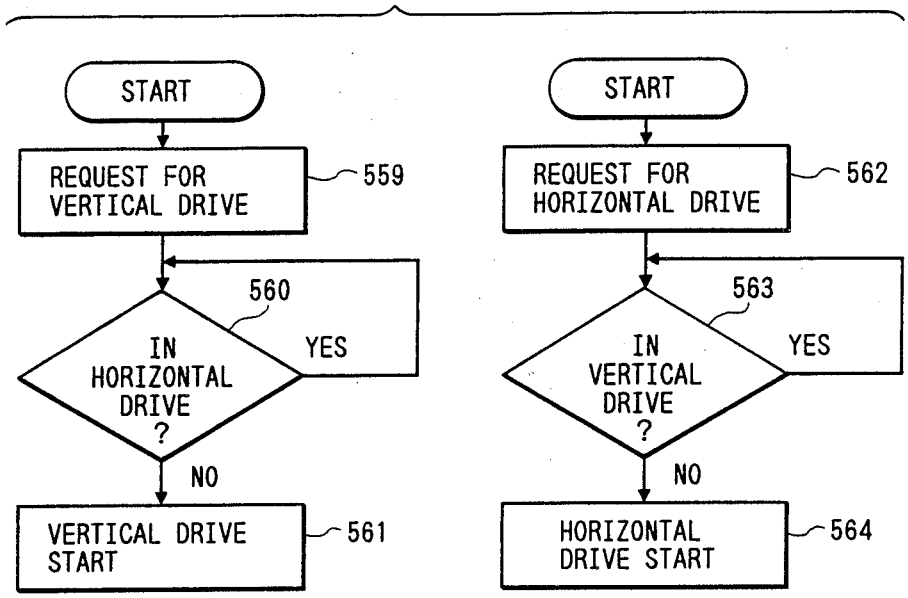
FIG. 15 is a flow chart showing an operation for simultaneously inhibiting horizontal and vertical drive operations.
Figure 16:
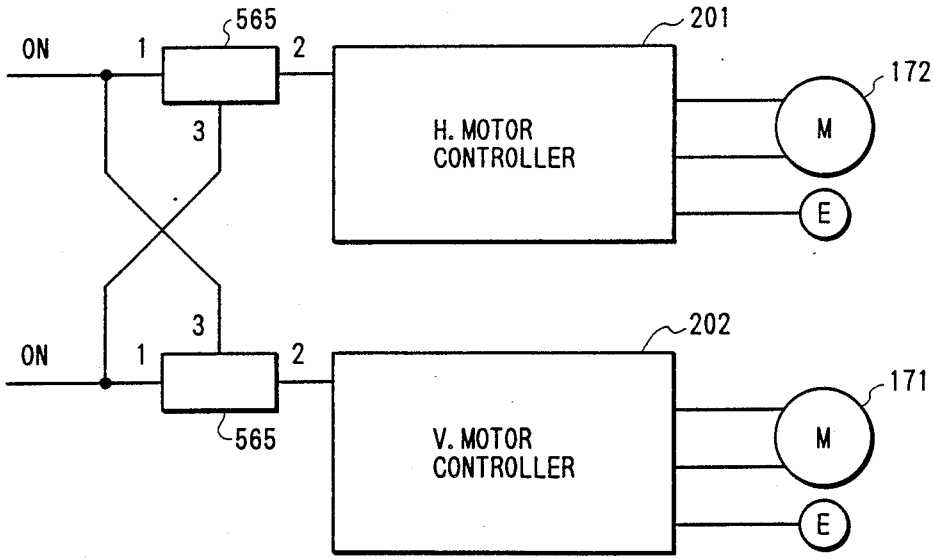
FIG. 16 is a view showing an interlock mechanism.

An embodiment of the present invention will be described hereinafter. For the sake of descriptive convenience, the arrangement and operation of an image forming apparatus using a "device for storing a plurality of developing units" of this embodiment will also be described. The main part of this embodiment is shown in FIGS. 15 and 16.

Figure 1:
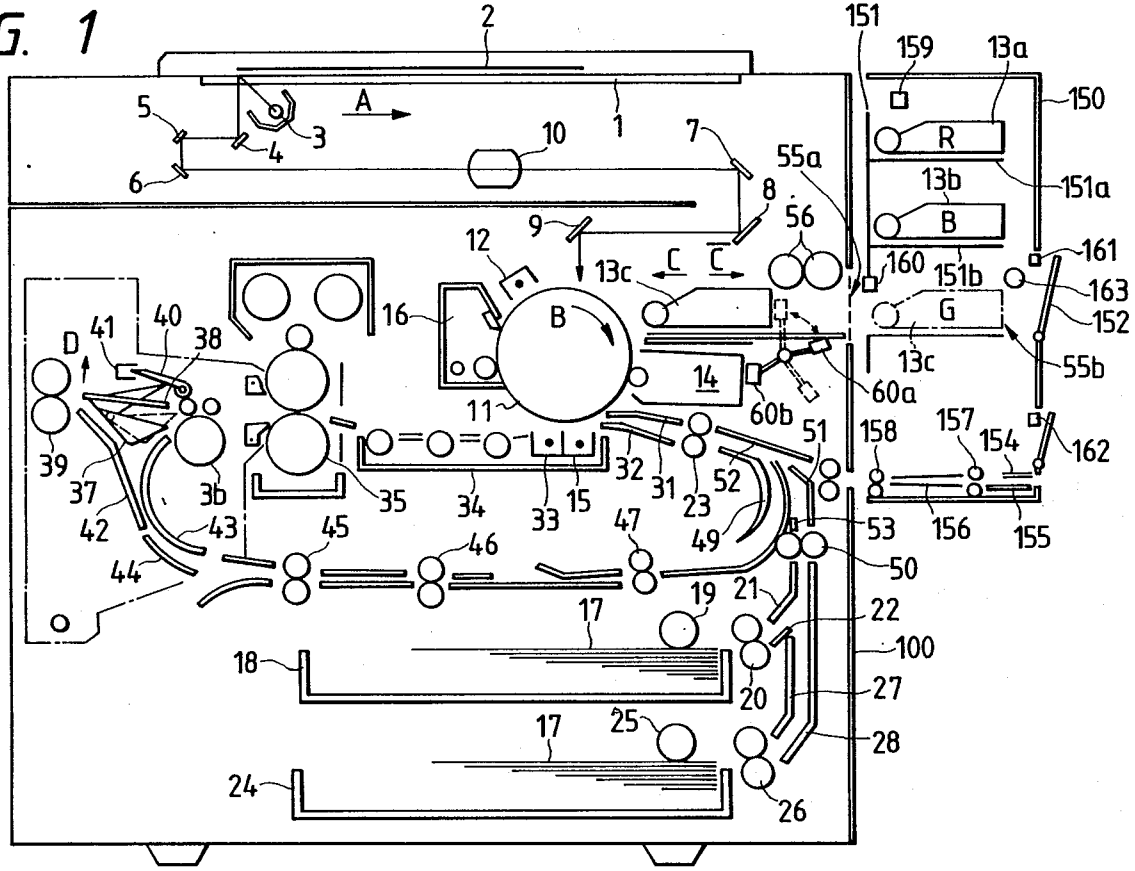
FIG. 1 is a schematic sectional view of an image forming apparatus comprising a device for storing a plurality of developing units according to the present invention.

FIG. 1 is a sectional view of an image forming apparatus (copying machine) to which a device for storing a plurality of developing units (to be referred to simply as a storage device hereinafter) according to an embodiment of the present invention is applied. The image forming apparatus shown herein has a structure capable of double-side image formation and multi-image formation using different colors.

Prior to a description of the storage device of this embodiment, an image forming apparatus main body to which the storage device is applied will be described below.

An original 2 placed on an original glass 1 is illuminated by a lamp 3, and this light source is guided onto a photosensitive drum 11 through an optical system constituted by reflection mirrors 4, 5, 6, 7, 8, and 9, and a zoom lens 10. The lamp 3 and the mirrors 4, 5, and 6 are moved in a direction of an arrow A at a predetermined speed to scan the original 2. After the outer surface of the photosensitive drum 11 is uniformly charged by a primary charger 12, the drum 11 is rotated in a direction of an arrow B. An electrostatic latent image corresponding to the original image is formed on the outer surface of the photosensitive drum 11. A color developing unit (green developing unit 13c) storing a color toner (e.g., green toner) and a black developing unit 14 storing a black toner are arranged around the photosensitive drum 11. These developing units 13c and 14 are movable in directions of arrows C and $\overline{C}$, and approach the photosensitive drum 11 in accordance with a desired color image to visualize the electrostatic latent image on the photosensitive drum 11. In FIG. 1, since the color developing unit (green developing unit 13c) is separated from the drum 11 and the black developing unit 14 comes close to the drum 11, a black image is formed on the drum 11. This image is transferred onto a transfer material (transfer sheet) 17 by a transfer charger 15. Thereafter, the photosensitive drum 11 reaches a cleaner 16, so that a residual toner on the outer surface of the drum is removed. Similarly, the next image forming process is performed.

The transfer material 17 is fed, and an original image is formed thereon as follows. Feeding of the transfer material 17 to an image forming means mainly constituted by the photosensitive drum 11 includes the following methods. In the first method, each of transfer materials 17 stacked in a cassette 18 is fed to a roller pair 20 by a sheet feed roller 19. When a plurality of transfer materials 17 are simultaneously fed to overlap each other, the roller pair 20 separates the uppermost transfer material 17, and feeds it to the image forming means. After the transfer material 17 passes through the roller pair 20, it reaches register rollers 23 through guide plates 21, 22, and 28, a sheet feed roller pair 50, and guide plates 51, 52, and 53. In the second method, each of transfer materials 17 stacked in a cassette 24 is fed to a roller pair 26 by a sheet feed roller 25. The roller pair 26 has the same function as that of the roller pair 20. After the transfer material 17 passes through the roller pair 26, it reaches the register rollers 23 through guide plates 27, 28, and 21, the sheet feed roller pair 50, and the guide plates 51, 52, and 53. The register rollers 23 begin to rotate in synchronism with a timing at which a visualized image on the photosensitive drum 11 and the transfer material 17 coincide with each other, and feed the transfer material 17 onto the outer surface of the photosensitive drum 11 through upper and lower transfer guides 31 and 32. As described above, the visualized image on the outer surface of the photosensitive drum 11 is transferred onto the transfer material 17 by the transfer charger 15, and the transfer material 17 is separated from the outer surface of the drum 11 by a separation charger 33. The transfer material 17 is then fed to a fixing device 35 having heating rollers and compression rollers. The image on the transfer material 17 which is heated and compressed by the fixing device 35 is fixed as a permanent image. Then, the transfer material 17 is fed to first exhaust rollers 36, and then reaches second exhaust rollers 39 through flappers 37 and 38 to be exhausted outside the copying machine. In FIG. 1, the flapper 38 disturbs a transfer material path. The flapper 38 is formed of a light material, and is pivotal in a direction of an arrow D. Thus, when the transfer material 17 passes through the flapper 38, the flapper 38 is pushed up by the leading end of the transfer material 17 to escape therefrom. Thus, the flapper 38 will not interfere with passage of the transfer material 17.

The flow of the transfer material 17 in a double-side image formation mode and a multi-image formation mode will be described below.

When the image forming apparatus is set in the double-side image formation mode, an original image is transferred and fixed on one surface (first surface) of the transfer material 17, and the material 17 is fed to the second exhaust rollers 39 to be exhausted onto a tray (not shown) outside the copying machine, in the same manner as in the single-side image formation mode described above. The trailing end of the transfer material 17 is detected by a transfer material detection mechanism constituted by a detection lever 40 and a photosensor 41. After the lapse of a predetermined period of time (i.e., a time required for the trailing end of the transfer material 17 to pass through the flapper 38), the second exhaust roller 39 begin to rotate in a reverse direction to feed the transfer material 17 into the copying machine again. The transfer material 17 is fed to rollers 45 through left inclined surfaces of the flappers 38 and 37, a guide plate 42, and guide plates 43 and 44 from its trailing end. Thereafter, the transfer material 17 reaches lateral register rollers 47 through rollers 46. In this case, the lateral register rollers 47 are stopped. After the transfer material 17 completely abuts against the rollers 47, the roller pairs 45 and 46 are also stopped. Thus, the transfer material 17 waits for an image forming operation onto its second surface. When an image forming signal for the second surface is issued, the lateral register rollers 47 begin to rotate to feed the transfer material 17 to the register rollers 23 through a guide plate 49. Before the transfer material 17 reaches the register rollers 23, the side edges of the transfer material 17 are detected by photosensors (not shown), and the lateral register rollers 47 are moved in a direction perpendicular to the moving direction of the transfer material 17, i.e., in a direction perpendicular to the surface of the drawing to correct a lateral position of the transfer material 17, so that the side edges are located at identical positions as in image formation of the first surface. The operation after the transfer material 17 reaches the register rollers 23 is the same as that in the single-side image formation mode described above. The transfer material 17, on the second surface of which an image is formed, is finally exhausted onto the tray outside the copying machine by the second exhaust rollers 39.

When the image forming apparatus is set in the multi-image formation mode, the first image formation operation is performed in the same manner as in the single-side image formation mode described above. After the first image formation operation, the flapper 37 is located in a state indicated by a broken line. Therefore, the transfer material 17 is fed from its leading end by the first exhaust rollers 36, and reaches the guide plates 42 and 43 along the right inclined surface of the flapper 37 to be turned over. Furthermore, the transfer material 17 is fed to the rollers 45 via the guide plates 43 and 44. Thereafter, the transfer material 17 reaches the lateral register rollers 47 via the rollers 46. When the trailing end of the transfer material 17 is detected by the detection lever 40 and the photosensor 41 and a predetermined period of time has passed after detection, the flapper 37 returns to a solid line position. When a second image forming signal is issued, the lateral register rollers 47 begin to rotate. In this case, the movement of the transfer material 17 is the same as that in the image formation operation for the second surface in the double-side image formation mode. In this manner, the transfer material 17 subjected to the second image formation is finally exhausted onto the tray outside the copying machine by the second exhaust rollers 39. Note that in this embodiment, two multi-image formation operations have been described. When three or more multi-image formation operations are performed, the movement of the transfer material 17 is basically the same as the above. In this case, the flapper 37 is returned from the broken line position to the solid line position before the last image formation.

A storage device 150 of this embodiment which is equipped as an option outside a main body 100 of the image forming apparatus with the above arrangement will be described below.

The storage device 150 is equipped as an option outside the main body 100 of the image forming apparatus when color image formation using color developing units except for the black developing unit 14 permanently arranged in the main body 100 of the image forming apparatus is desired, and feeds a desired color developing unit near the photosensitive drum 11 inside the main body 100 of the image forming apparatus.

Figure 2:
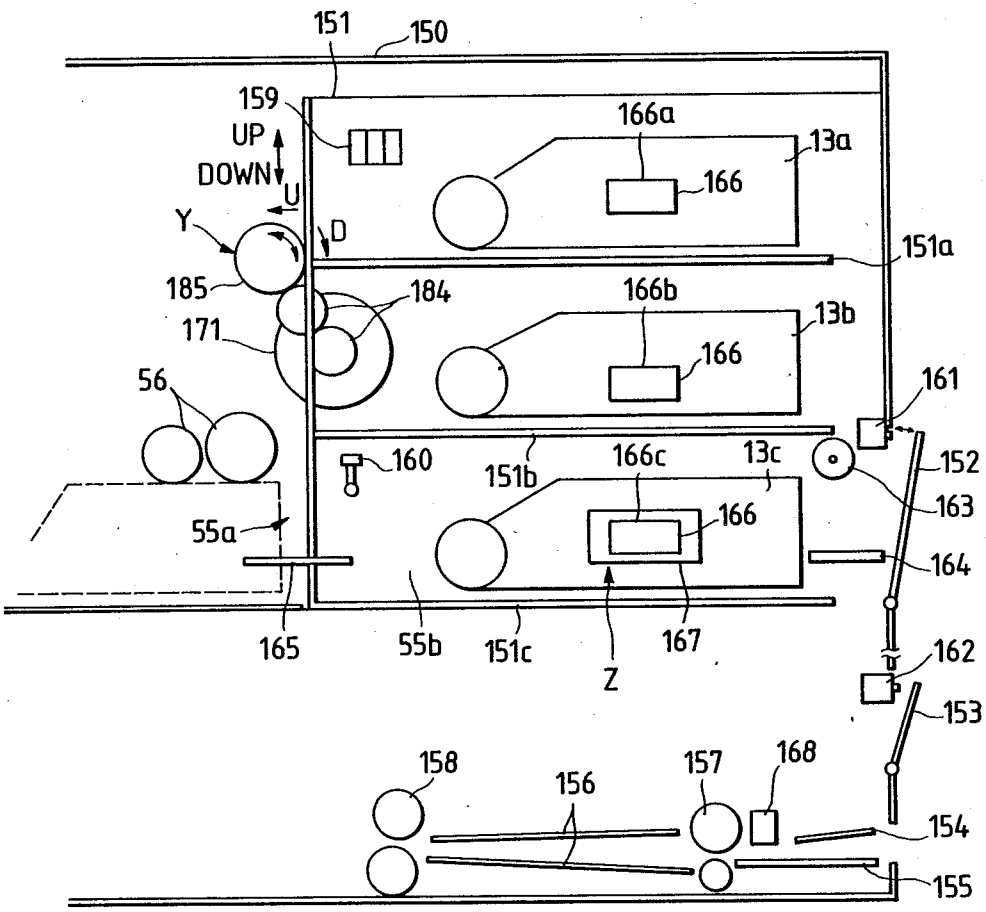
FIG. 2 is a schematic longitudinal sectional view of the embodiment shown in FIG. 1.

Partition plates (developing unit storage portions) **151*a*, 151*b*, and 151*c* for partitioning the interior of the device 150 are provided in a storage case 151 as a main body of the storage device 150. Color developing units respectively storing different color toners, e.g., a red developing unit 13*a* storing a red toner, a blue developing unit 13*b* storing a blue toner, and a green developing unit 13*c* storing a green toner are respectively stored and placed on the partition plates 151*a*, 151*b*, and 151*c* to be detachable toward the main body 100. In FIG. 2, the green developing unit 13*c* is not present in the storage case 151, and is conveyed to a position near the photosensitive drum 11 in the main body 100 to prepare for visualizing an electrostatic latent image. The color developing unit (green developing unit 13*c*) is conveyed by a developing unit conveying means X shown in FIG. 3A (to be described later). In this case, each color developing unit in the storage case 151 is taken into the main body 100 through a taking in port (developing unit taking out/in port) 55*a* formed on the main body 100**.

The storage device 150 described above is provided with a case moving means Y shown in FIG. 2 (to be described later). The storage case 151 is vertically movable by the case moving means Y with respect to the main body 100. Therefore, by the case moving means Y, a corresponding one of the partition plates **151*a* to 151*c* which supports a desired color developing unit is caused to coincide with the taking in port 55*a* of the main body 100 (in FIG. 2, the partition plate 151*c* coincides with the port 55*a*), and the desired color developing unit can be taken into the main body 100. For example, a case will be described below wherein the image forming apparatus selects the red developing unit 13*a*. First, the green developing unit 13*c* is conveyed and placed onto the partition plate 151*c* of the storage case 151 by the developing unit conveying means X. When the green developing unit 13*c* is returned to the storage case 151, the presence of the green developing unit 13*c* is confirmed by a developing unit lock sensor shown in FIG. 3A (to be described later). When the presence of the green developing unit 13*c* is confirmed, the storage case 151 is moved in the vertical direction with respect to the main body 100 (in this case, downward), and is stopped after it is moved to a position (a developing unit taking in portion 55*b*) where the partition plate 151*a* supporting the desired red developing unit 13*a* coincides with the taking in port 55*a* of the main body 100. Next, the red developing unit 13*a* is conveyed to a position near the photosensitive drum 11 by the developing unit conveying means X to prepare for visualizing an electrostatic latent image. Note that when another color developing unit in the storage case 151 is selected, the same operation as for the red developing unit 13*a*** is performed.

Means for guiding the green developing unit **13*c* shown in FIG. 1 from the storage case 151 to a position near the photosensitive drum 11, and means for guiding it from the position near the photosensitive drum 11 to the storage case 151** will be described below with reference to FIG. 3A.

Figures 3A, 3B:
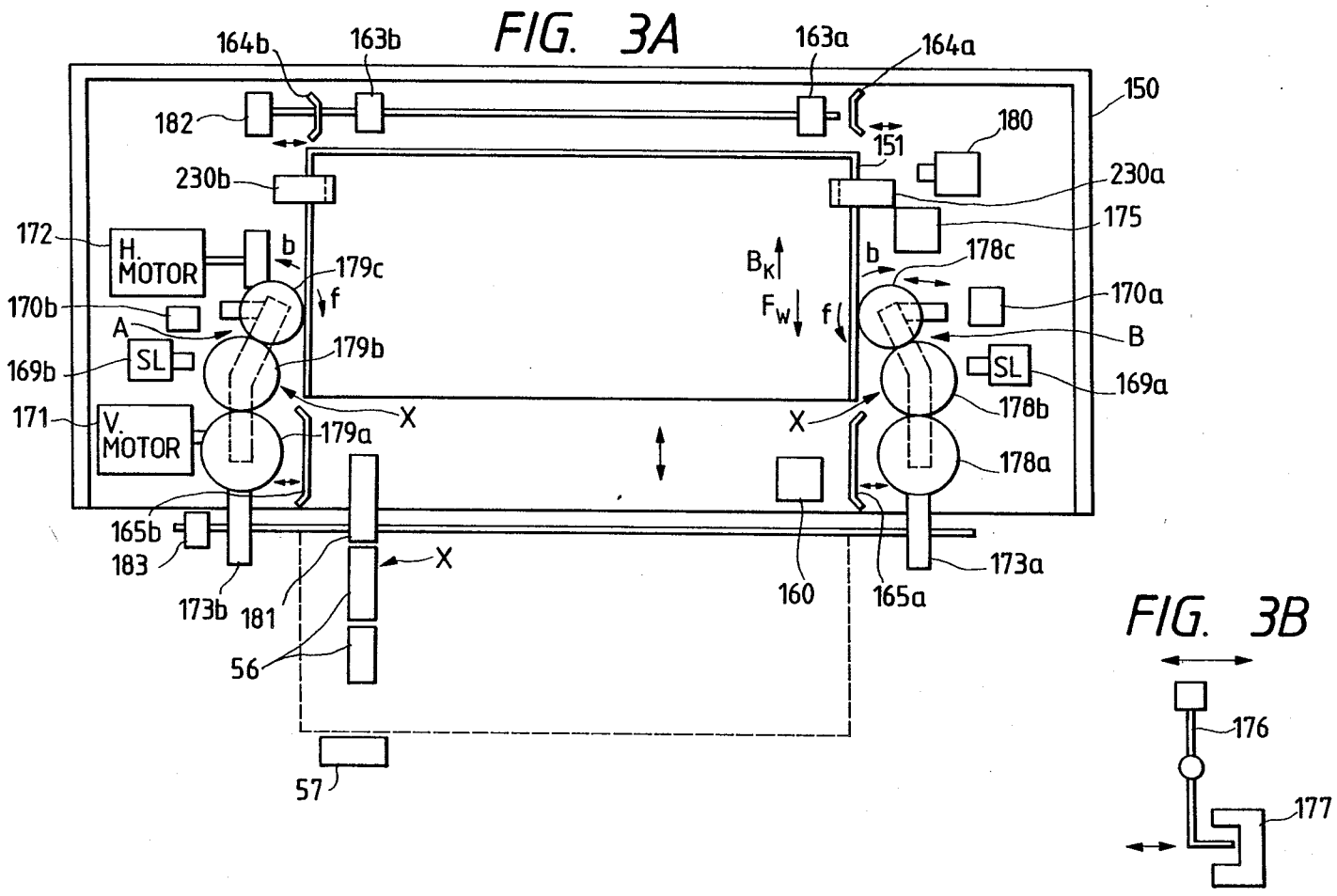
FIG. 3A is a schematic cross-sectional view of the embodiment shown in FIG. 1.
FIG. 3B is a view showing an arrangement of a developing unit position sensor.

Developing unit horizontal moving means A and B shown in FIG. 3A convey the color developing unit **13*c* in an $F_W$ (forward) direction and $B_K$ (back) direction shown in FIG. 3A upon rotations of color developing unit drive gears 178*c* and 179*c*. In the horizontal moving means A and B, when a horizontal motor 172 is rotated, drive transmission gears 173*a* and 173*b* are rotated. The rotation of the gear 173*a* is transmitted to the gear 178*c* for horizontally moving the color developing unit 13 using gears 178*a* and 178*b*. Similarly; the rotation of the gear 173*b* is transmitted to the gear 179*c* using gears 179*a* and 179*b*. Gears for transmitting rotation of the horizontal motor 172** are not shown in FIG. 3A.

The developing unit horizontal moving means A and B are pressed against the color developing unit **13*c* in the storage case 151 by springs (not shown). When the developing unit storage case 151 is moved in an up or down direction shown in FIG. 2 by the developing unit vertical moving means Y, the horizontal moving means A and B drive solenoids 169*a* and 169*b* to be separated from the storage case 151. With this arrangement, the horizontal moving means A and B do not interfere with the color developing unit vertical moving means Y. Sensors 170*a* and 170*b* are arranged to detect that the horizontal moving means A and B are sufficiently separated from the storage case 151. The sensors 170*a* and 170*b*** comprise known photointerrupters, and detect separation of the horizontal moving means A and B.

Figure 4:
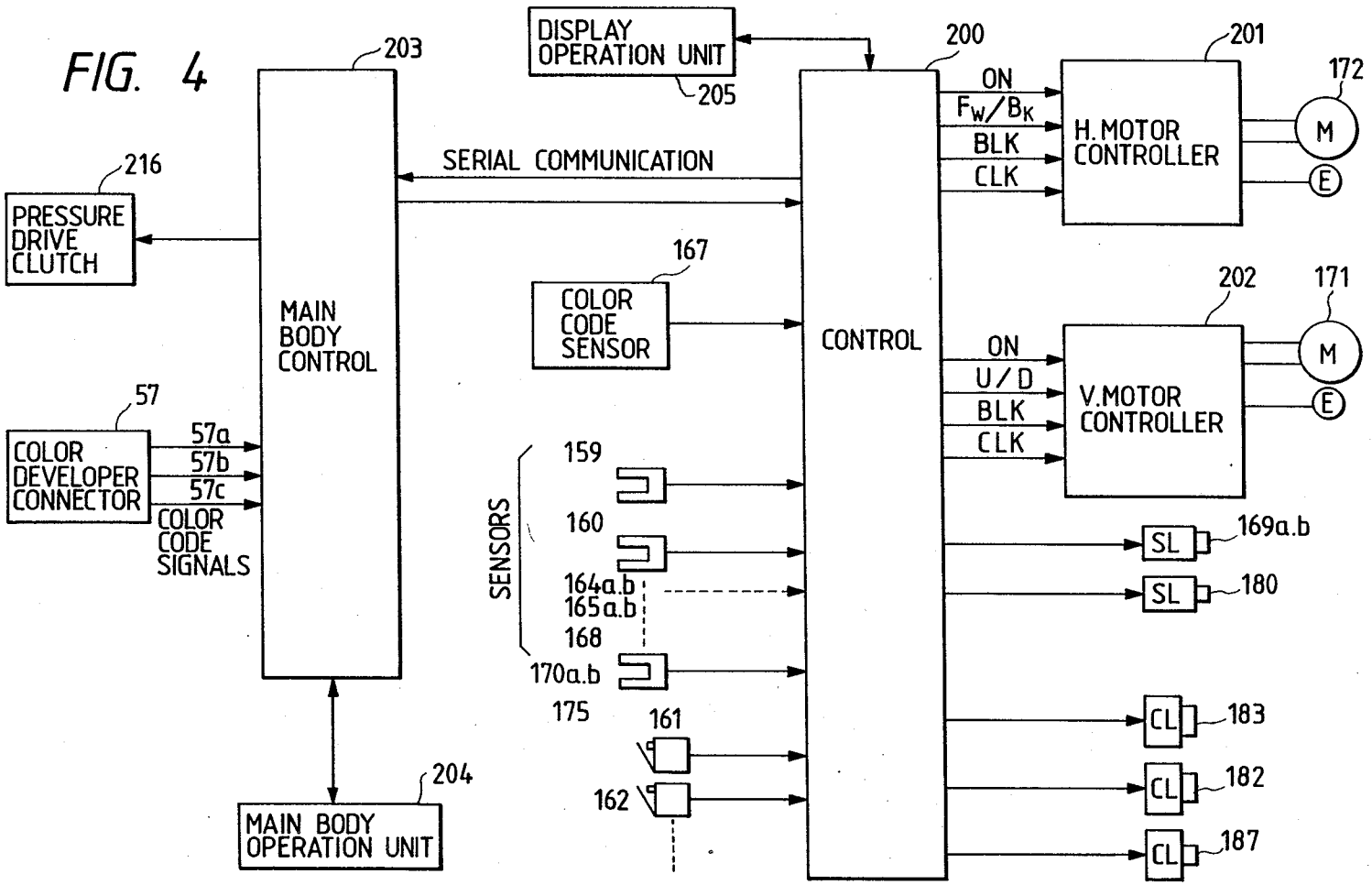
FIG. 4 is a block diagram of a controller.
Figure 6:
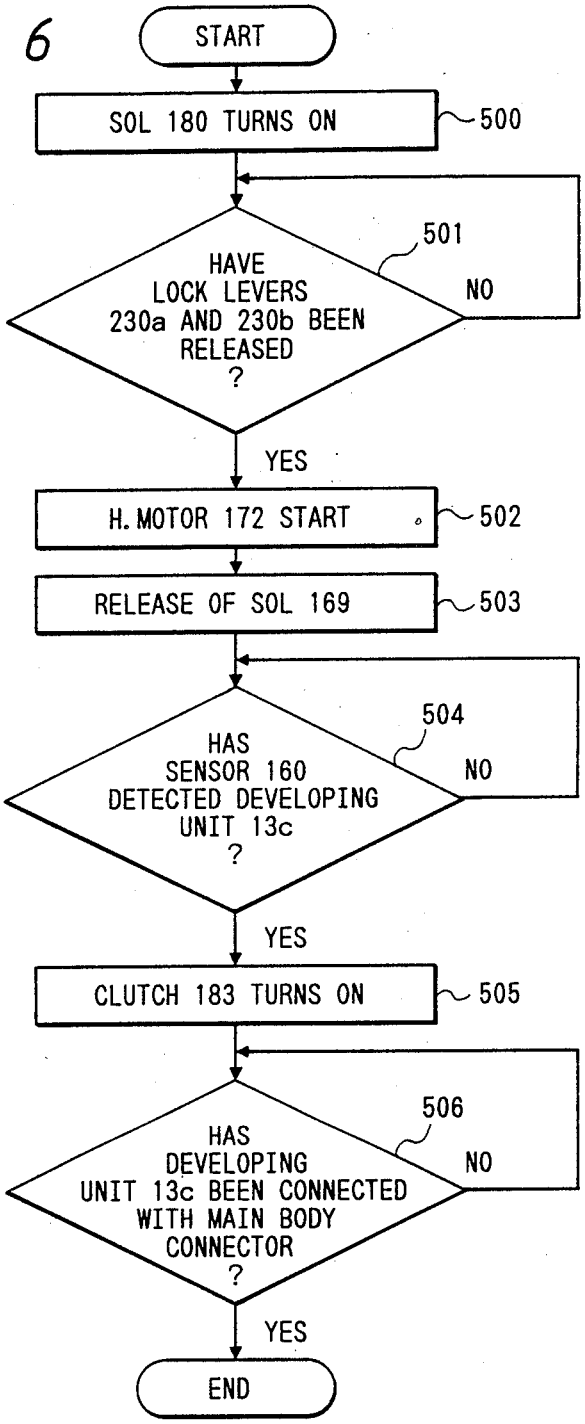
FIG. 6 is a flow chart showing a horizontal taking in sequence.

A case will be described below wherein the green developing unit **13*c* is guided from the partition plate 151*c* of the storage case to a position near the photosensitive drum 11 (FIG. 6). Assume that the partition plate 151*c* of the storage case stands still at the position of the main body taking in port 55*a*. The green developing unit 13*c* is fixed to the partition plate 151*c* of the storage case by developing unit lock levers 230*a* and 230*b*. The lock levers 230*a* and 230*b* have a mechanism such that the color developing unit 13*c* is released by a color developing unit lock release solenoid 180 (FIGS. 3 and 4). After the release solenoid 180 is driven (step 500), it is confirmed whether or not the lock levers 230*a* and 230*b* are released (step 501). Thereafter, the horizontal motor 172 is rotated (step 502), and the solenoids 169*a* and 160*b* are released and the horizontal moving means A and B are driven (step 503). In this case, the horizontal moving means A and B are pressed against the green developing unit 13c in the storage case 151. (When drive of the solenoid is released, the horizontal moving means A and B are pressed against the green developing unit 13c in the storage case 151** by springs.)

When the drive gears 178c and 179c are rotated in the $F_W$ direction, the green developing unit 13c is conveyed to the main body taking in port 55a. When the green developing unit is conveyed to the main body taking in port 55a and is detected by a horizontal home sensor 160, a clutch 183 is turned on (steps 504 and 505). Thus, the unit is conveyed to a position near the photosensitive drum 11 by the gear 56 in the main body.

The gear 56 is rotated through a drive transmission gear 181 upon rotation of the horizontal motor 172. The horizontal motor 172 is driven by the gear 181 by controlling the clutch 183.

In this case, developing unit press levers 60a and 60b in the main body press the black developing unit in the main body and do not interfere with conveyance of the green developing unit. In this state, a developing unit connector 57 in the main body is connected to the green developing unit 13c (FIG. 7A), and an input signal from the developing unit connector 57 is supplied to a main body control unit 203 (to be described later). When it is detected that the green developing unit is connected to a main body connector, the horizontal taking in sequence is ended. Thereafter, when image formation is performed using the green developing unit 15c, the press levers 60a and 60b are rotated, so that the black developing unit 14 is separated from the photosensitive drum 11, and the green developing unit 13c is pressed by the levers under the control of the main body control unit 203.

Figure 8:
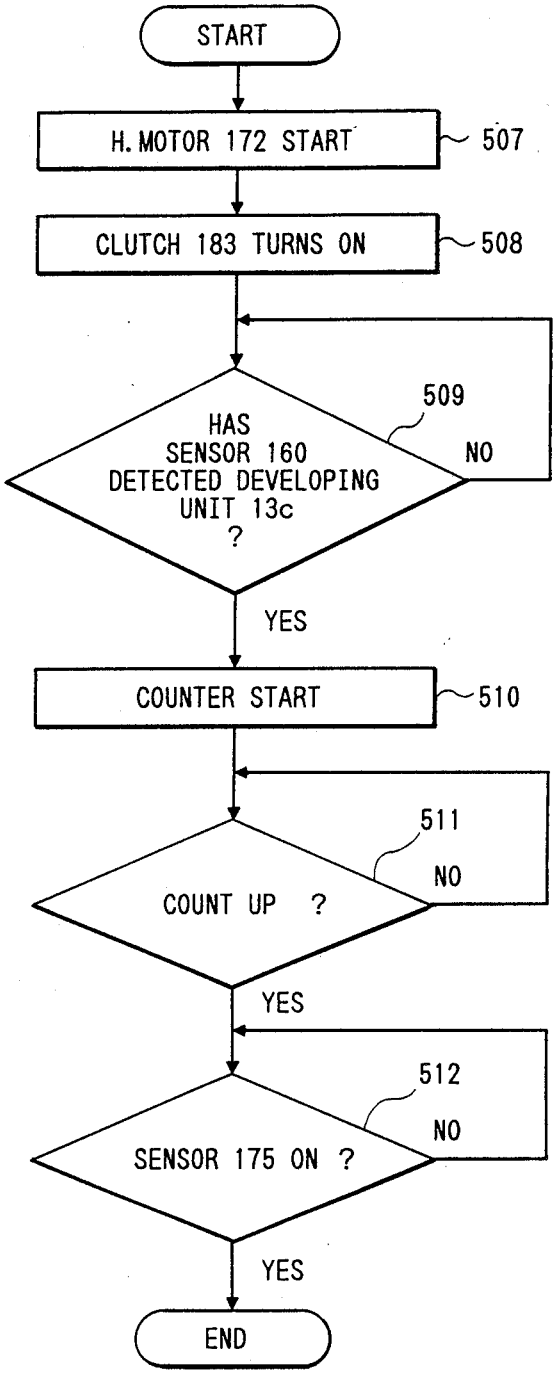
FIG. 8 is a flow chart showing a horizontal carrying out sequence.

A case will be described below wherein the green developing unit 13c located near the photosensitive drum 11 is conveyed onto the partition plate 151c of the storage case (FIG. 8).

When the green developing unit 13c is pressed against the photosensitive drum 11 in the main body, the press levers 60a and 60b are rotated to release pressing of the green developing unit 13c. The horizontal motor 172 is rotated (step 507), and the gear 56 for conveying the developing unit is rotated by turning on the clutch 183 (step 508).

Upon rotation of the developing unit carrier gear 56, the horizontal moving means A and B are rotated to carry the green developing unit 13c into the storage case 151. When the horizontal home sensor 160 detects the passage of the green developing unit 13c, a counter is started (step 510). When a predetermined value is counted by the counter (step 511), it is checked whether or not a developing unit lock sensor 175 is turned on (step 512). If YES in step 512, the horizontal carrying out sequence is ended. The developing unit lock sensor 175 detects that the green developing unit 13c is moved in the $B_K$ direction in FIG. 3A from the inside of the main body, and the developing unit lock levers 230a and 230b are pressed at predetermined positions by the springs. Thus, the green developing unit 13c is fixed to the storage case 151 in this state. The horizontal home sensor 160 (FIG. 3A) serves as a reference point for conveying the color developing unit 13 in the $B_K$ or $F_W$ direction in FIG. 3A by the horizontal moving means A and B. The horizontal home sensor 160 employs a photointerrupter to detect the passage of the developing unit 13.

Figure 9:
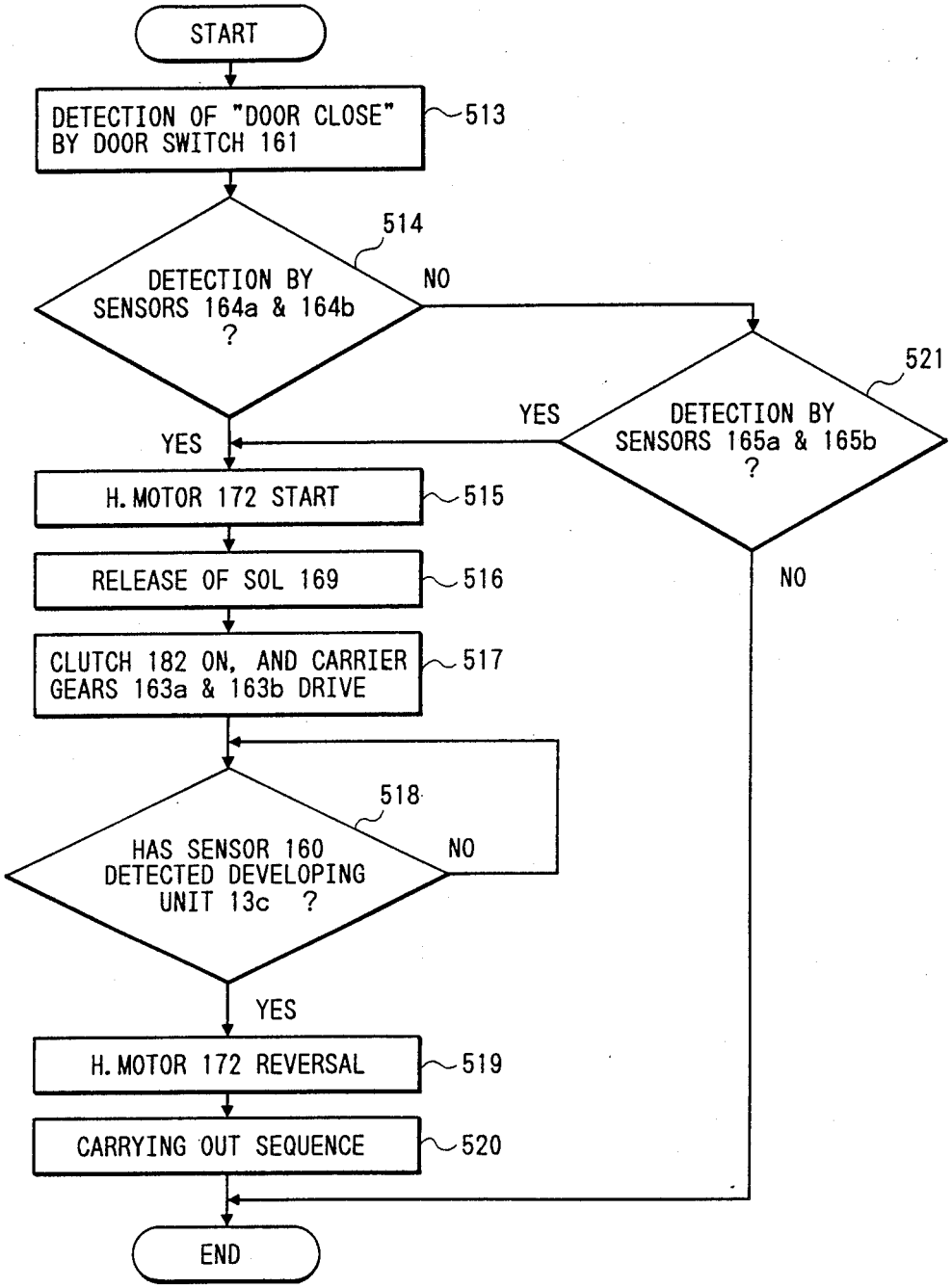
FIG. 9 is a flow chart showing a horizontal door-close sequence.

A case will be described below wherein the color developing unit 13 is manually taken in from a door 152 (FIG. 9). When the color developing unit 13 is manually stored in the storage case 151, an open/close state of the door 152 is detected by a door switch 161 (step 513), and a detection signal is input to a control unit 200 (to be described later). When the door 152 is closed, whether or not the color developing unit 13 is manually taken in is detected by developing unit detection sensors 164a and 164b (FIG. 3A) (step 514). If YES in step 514, the horizontal motor 172 is turned on (step 515), and the solenoids 169a and 169b are released, so that the horizontal moving means A and B are brought into contact with the storage case 151 (step 516). Furthermore, a clutch 182 is turned on, so that the drive force of the horizontal motor 172 is transmitted to carrier gears 163a and 163b (step 517). Thus, the developing unit is conveyed into the storage case 151 by the carrier gears 163a and 163b. When the passage of the color developing unit is detected by the horizontal home sensor 160 (step 518), the horizontal motor 172 is reversed (step 519), and the carrying out sequence shown in FIG. 8 described above is executed (step 520), thus completing storage of the color developing unit.

When the sensors 164a and 164b do not detect the color developing unit, the outputs from developing unit detection sensors 165a and 165b are checked (step 521). If YES in step 521, the horizontal motor 172 is turned on (step 515), and the same operation as described above is performed to store the color developing unit. If NO in step 521, it is determined that the color developing unit is not carried, and the processing is ended.

The sequence shown in FIG. 9 must be executed as a protection sequence immediately before a vertical sequence. When the door is opened, the drive sources of the motors are disabled.

Figure 10:
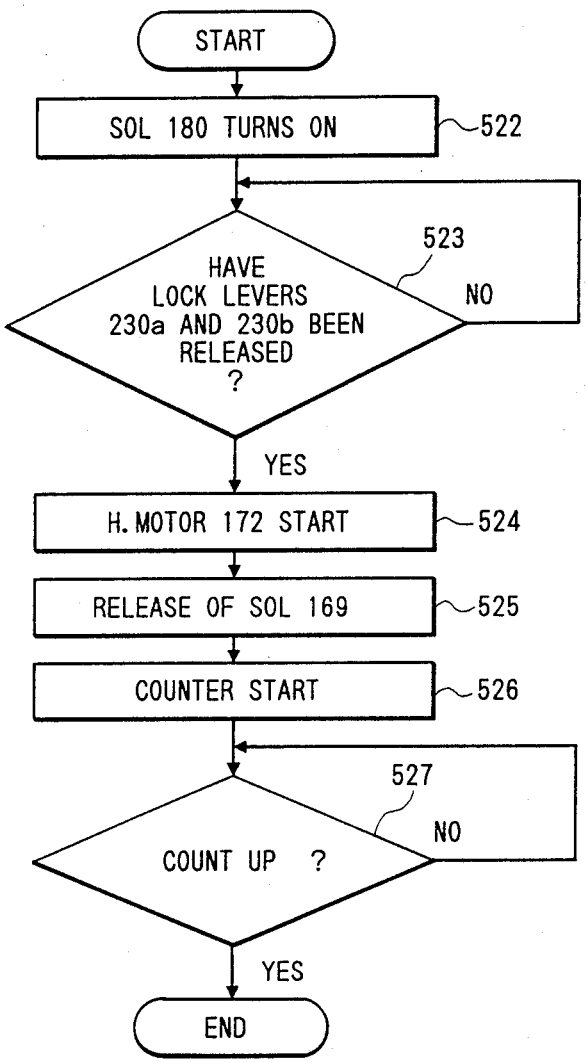
FIG. 10 is a flow chart showing a horizontal external taking out sequence.

A case will be described below with reference to the flow chart of FIG. 10 wherein the color developing unit 13 is taken out of the storage device of this embodiment.

The lock release solenoid 180 is turned on (step 522), and whether or not locking of the color developing unit is released is checked on the basis of the output from the sensor 175 (step 523). If YES in step 523, the horizontal motor 172 is started (step 524), and the solenoids 169a and 169b are released (step 525), so that the horizontal moving means A and B are pressed against the storage case 151. Then, the color developing unit is carried in the $B_K$ direction until the counter counts a predetermined value (steps 526 and 527).

Thus, the color developing unit is conveyed by the horizontal moving means A and B by a predetermined distance in the $B_K$ direction. In this manner, the color developing unit 13 is conveyed to a position near the door 152 to facilitate exchange of the color developing units.

FIG. 3B shows an arrangement of the developing unit detection sensors 164a, 164b, 165a, and 165b. A photointerrupter 177 detects the presence/absence of the color developing unit 13 in accordance with the movement of a developing unit detection lever 176.

The storage case moving means Y will be described below with reference to FIG. 2. The storage case 151 is driven by a vertical motor 171. The rotation of the vertical motor 171 is transmitted to a pinion 185 through a gear 184. The storage case 151 is moved in an up or down direction shown in FIG. 2 by a combination of a rack 186 (not shown) on the side surface of the storage case and the pinion 185. A vertical home position sensor 159 is used for positioning the storage case 151. The position of each stage is determined by an output count of an encoder or a count of a timer of the vertical motor 171 from this sensor position.

A color detection mark 166 is adhered to each of the color developing units 13*a*, 13*b*, and 13*c* to identify a corresponding color. Every time the color developing units 13*a*, 13*b*, and 13*c* pass by a color detection sensor 167 by the case moving means Y, the colors of the developing units 13 on the partition plates 151*a*, 151*b*, and 151*c* of the storage case are detected.

A sequence to be described below is realized by a combination of horizontal and vertical sequences.

An operation of a developing unit exchange sequence when a copying color is designated by the main body will be described below. When a color is designated by a developing unit color selection key on a main body operation unit 204 in FIG. 5, the designated color developing unit is inserted in the main body in accordance with the developing unit exchange sequence shown in FIG. 11. The color of the color developing unit in the main body, which is discriminated by color code signals 57*a*, 57*b*, and 57*c* input to the main body control unit 203, is compared with the designated color. When the color of the developing unit is equal to the designated color, the developing unit exchange sequence is ended (step 529). When there is no color developing unit in the main body, the flow jumps to step 534. When the color developing unit having a color different from the designated color is present in the main body, an empty stage in the storage case 151 is located (step 530). In this case, the empty stage may be located from the upper or lower stage side. The empty stage is advantageously located from the lower stage side since the storage case 151 need only be moved by a small distance. Subsequently, the carrying out sequence is performed (step 532). The storage case 151 is moved in the vertical direction and is returned to the home position (step 533). The storage case 151 is moved in the vertical direction to adjust the storage case storing the designated color developing unit to a taking in position (step 534). Thereafter, the taking in sequence is executed to take the designated color developing unit into the main body (step 535).

Since the exchange between the main body and the storage device 150 ends, the main body side can be independently operated. Thereafter, the storage case 151 is returned to the vertical home position (step 536). When the developing units are exchanged with this method, all the developing units stored in the storage device 150 can be set in the main body in turn. Thus, a multi-color copying operation using, e.g., blue, red, black, brown, and the like can be performed.

Figure 12:
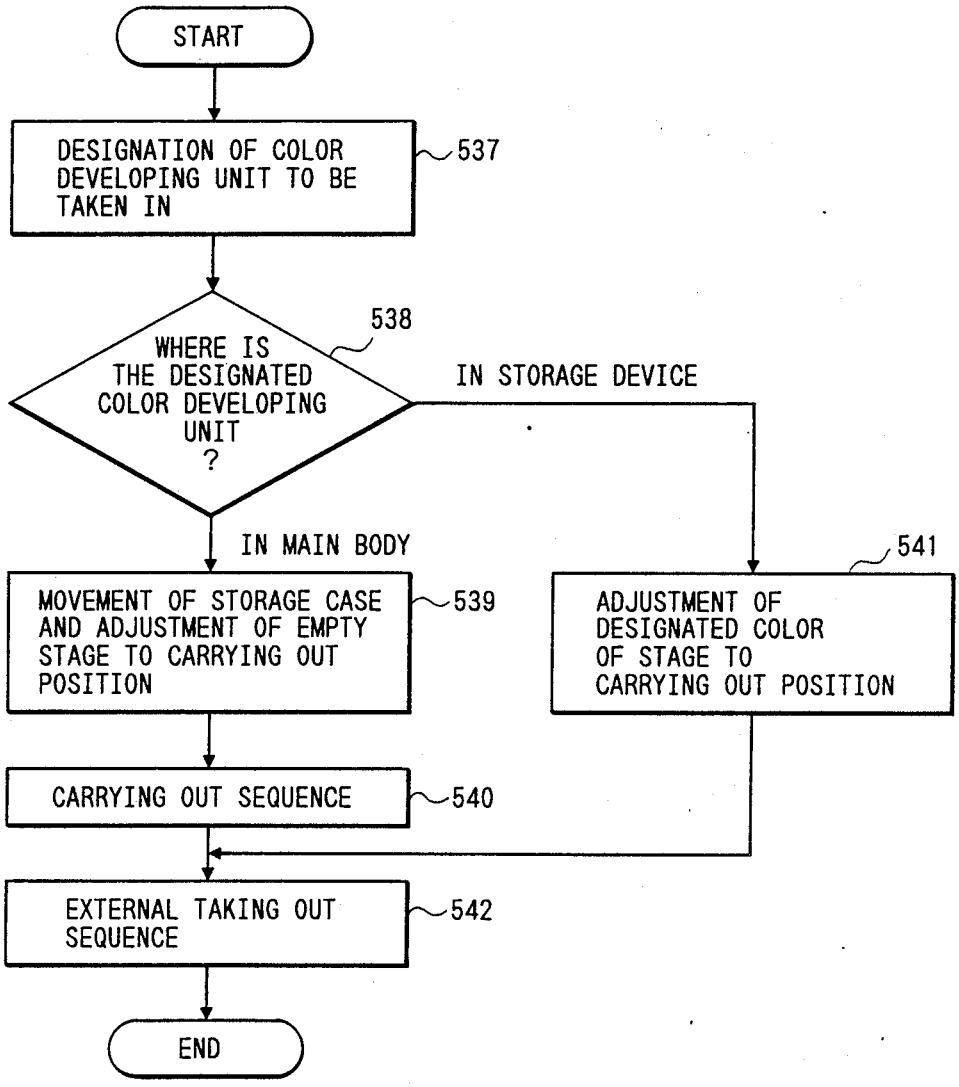
FIG. 12 is a flow chart showing a developing unit external taking out sequence.

An operation of a sequence for taking out the developing unit from the main body and the storage device will be described below with reference to FIG. 12. A color of the developing unit to be taken out is selected by a Select key 220 (FIG. 5B) on a storage device operation unit 225 (to be described later). When the color developing unit to be taken out is determined by depressing an Eject key 221 (step 537), it is checked if the developing unit to be taken out is present in the main body or the storage device (step 538). If the developing unit is present in the main body, an empty stage in the storage case 151 is moved to the carrying out position (developing unit taking out/in portion) 55*a* using the vertical moving means (step 539), and the developing unit is moved into the storage case 151 by the horizontal carrying out sequence (step 540) shown in FIG. 8. If the developing unit is present in the storage device, the empty stage is similarly moved to the carrying out position. In both the cases, the developing unit is moved in front of the door 152 by the horizontal external taking out sequence shown in FIG. 10 (step 542).

When there is a possibility of exchange of the developing units or insertion of a new developing unit upon rising up of the power source or opening/closing of the door 152, an initialization sequence for detecting the color of each stage or the presence/absence of the developing unit is performed. The operation of this sequence will be described below with reference to FIG. 13. The developing unit is fixed at a predetermined position in the storage case by the door-close sequence in FIG. 9. The vertical home sensor 159 detects whether or not the storage case is at the home position (step 545). If NO in step 545, the vertical motor 171 is driven vertically upward to return the storage case to the home position (steps 546 and 547). Subsequently, the vertical motor 171 is driven downward until the counter counts up (step 548). In this case, the color of the developing unit of each stage is detected by the color detection sensor 167, and is input to the control unit 200 (steps 549 to 551). Finally, the vertical motor 171 is moved upward to return the storage case to the home position.

The basic sequence of the storage device includes a sequence for, when a home sensor cannot detect the storage device within a predetermined period of time during vertical/horizontal movement, informing an abnormal state to the main body to stop the operation of the storage device.

A case will be described below wherein the storage device is operated in cooperation with the copying operation.

Figure 11:
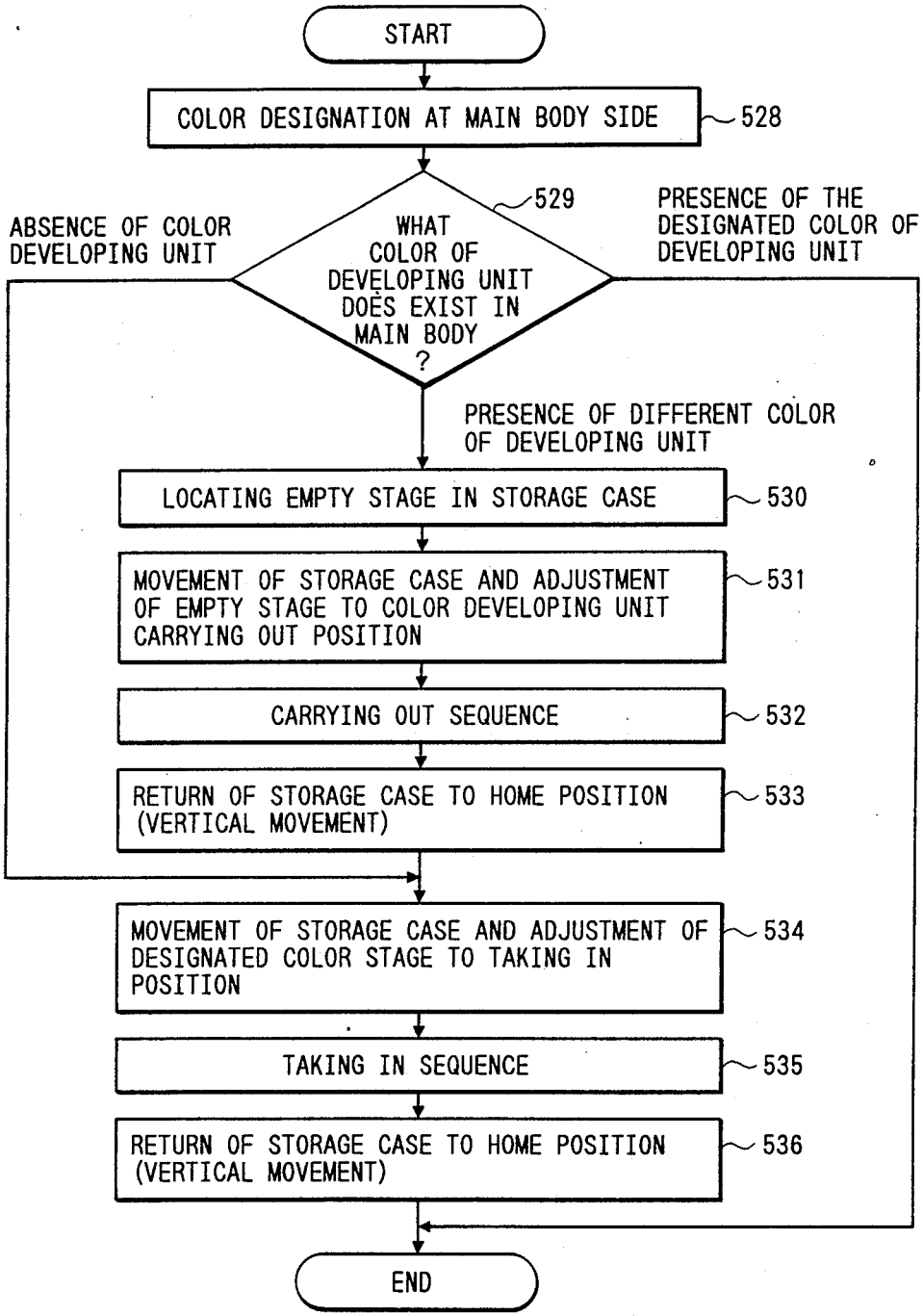
FIG. 11 is a flow chart showing a developing unit exchange sequence.

A color is selected by a color selection key 217 on the main body operation unit 204, and a copy mode is set by another key. If the color developing unit is exchanged at this time, there is a possibility of changing a color before a copy key 207 is depressed. Thus, the color developing unit to be used is determined when the copy key 207 is depressed, and the developing unit exchange sequence shown in FIG. 11 is then executed. When two or more colors are used, the color developing unit present in the main body is used first to shorten a time required for exchanging the developing units. During only a wait-up time immediately after power-on or the like, the color developing unit selected by the color selection key is exchanged or the color developing unit in the main body is pressed or subjected to preliminary stirring, thus shortening a time when the color developing unit is used.

When a new developing unit is taken in upon exchange of the developing units, the storage case 151 is moved independently of the copying sequence of the main body. Therefore, before the storage case 151 is returned to the vertical home position, the copying sequence can be started. When copy sheets and toner must be replenished during the copying sequence, inputs of the color selection key 217 of the main body operation unit 204 and the Eject key 221 of the operation unit 225 of the storage device 150 are inhibited so as to inhibit exchange of the developing units in the main body 100 and the storage device 150. This is to assure the designated color developing unit when the copying sequence is restarted.

Figure 14:
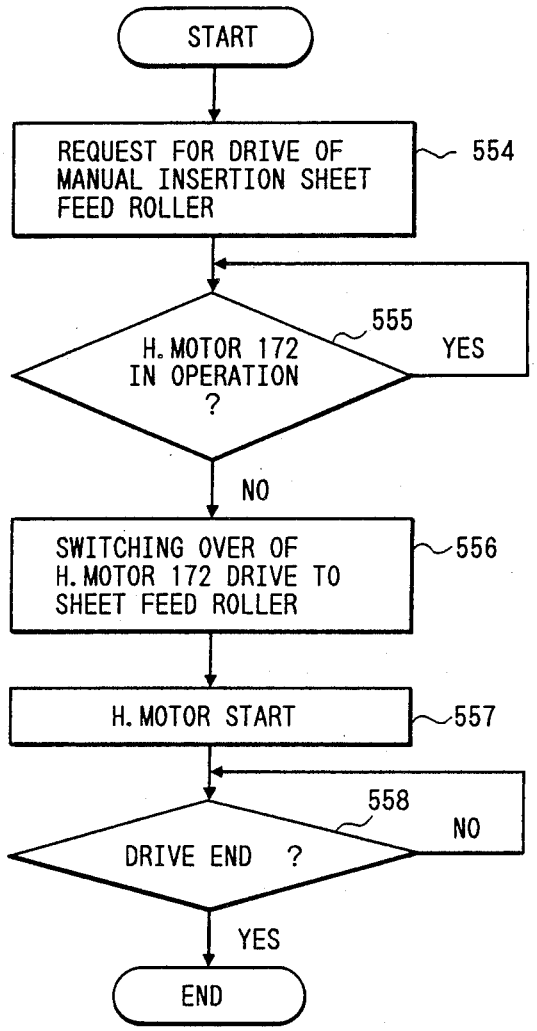
FIG. 14 is a flow chart showing a manual insertion sheet feed sequence.

The storage device 150 is provided with sheet feed rollers 157 and 158 and guide plates 154, 155, and 156 for a manual insertion sheet feed operation, and a paper sheet inserted to a main body manual insertion sheet feed roller 54 is fed. For easy maintenance of the manual insertion sheet feed section, a door 153 and a door open/close detection switch 162 are arranged. A manual insertion sequence will be described below with reference to FIG. 14.

A manual insertion sheet detection sensor 168 shown in FIG. 2 detects that a paper sheet is inserted in a manual insertion port 167, and outputs a manual insertion sheet feed roller drive request signal (step 554). If it is determined that the horizontal motor 172 is not in operation (step 555), a clutch (not shown) is turned on to transmit a drive force of the horizontal motor 172 to the sheet feed rollers 157 and 158 (step 556), thus driving the horizontal motor 172 for a predetermined period of time (steps 557 and 558). The sheet feed rollers 157 and 158 are driven by the clutch. During manual insertion drive, a drive force of the horizontal motor 172 cannot be transmitted to the color developing unit carrier gear 56 and the horizontal moving means A and B upon operation of a clutch (not shown).

The vertical motor 171 and the horizontal motor 172 must be driven after checking operations shown in FIG. 15. More specifically, when a vertical drive request is issued, vertical drive is started under the condition that horizontal drive is not performed (steps 559 to 561). When a horizontal drive request is issued, horizontal drive is started under the condition that vertical drive is not performed (steps 562 to 564). Thus, the developing unit cannot be simultaneously driven in both the horizontal and vertical directions. However, the manual insertion roller and the vertical drive can be performed at the same time.

When the designated color developing unit is absent in the main body, a manually inserted sheet is fed to the position of the sheet feed rollers 158 by the sheet feed rollers 157, and then, the drive mode of the horizontal motor 172 is switched to the developing unit carrying side. Thus, the developing units are exchanged by the developing unit exchange sequence shown in FIG. 11. After the color developing unit is preliminarily stirred, the manually inserted sheet is fed into the main body by the sheet feed rollers 157 and 158.

In FIG. 15, interlocking functions in a software manner in the control unit 200. Alternatively, interlocking may function in a hardware manner using switching elements, as shown in FIG. 16.

In FIG. 16, a switching element 565 has a function of disconnecting an electrical connection between terminals 1 and 2 when an ON signal input to a horizontal or vertical motor controller 201 or 202 is input to its terminal 3. With this arrangement, when an ON signal is input to either motor controller, the ON signal of the other motor controller is disabled. Therefore, the two motor controllers are never operated simultaneously. This arrangement also serves as a protection means when the control unit 200 for controlling the motor ON signals overruns.

In FIGS. 15 and 16, drive sources such as motors are interlocked. Interlocking may function by shifting a moving means such as gears, rollers, and the like, as a matter of course.

With this arrangement, the developing unit can be prevented from being simultaneously moved in two different directions, i.e., an erroneous operation can be prevented. Therefore, the developing unit can be prevented from being stopped at an abnormal position or the storage device or the developing unit can be prevented from being broken by forcible movement (or drive).

Figure 5A:
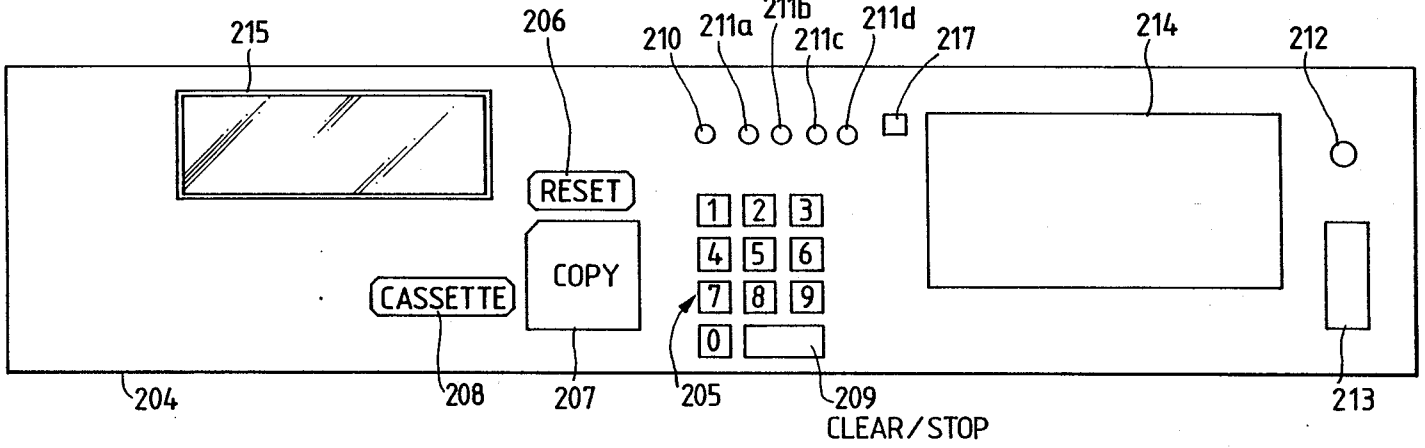
FIG. 5A is a view showing an arrangement of operation keys and indicators of a main body operation unit.

FIG. 4 is a block diagram showing a controller of the image forming apparatus equipped with the storage device of this embodiment, and the storage device as an option. For control of the image forming apparatus, only a portion associated with this embodiment is illustrated. The controller is constituted by the control unit 203 of the image forming apparatus (to be referred to as the main body control unit 203 hereinafter), and the control unit 200 of the storage device 150 of this embodiment. The main body control unit 203 and the control unit 200 exchange abnormal data, color data of the color developing units, and the like by known data communication (serial communication) to perform control. The main body control unit 203 monitors and controls the color code signals 57*a*, 57*b*, and 57*c* of the color developing units 13, which are input upon connection of a pressure drive clutch 216 for pressing the color developing unit 13 conveyed into the main body by the control unit 200 against the photosensitive drum 11 and the developing unit connector 57, and the main body operation unit 204. The main body operation unit 204 is a main-machine interface for inputting an image formation start key (copy key) and inputting/outputting various data, and is arranged as shown in FIG. 5A.

On the basis of the communication data sent from the main body control unit, the control unit 200 of the storage device of this embodiment performs control for taking in the color developing unit 13 to a position near the photosensitive drum 11 of the main body, control for carrying out the color developing unit 13 located near the photosensitive drum 11 to the storage case 151, control for conveying the color developing unit 13 to a position near the door 152 and taking out the color developing unit 13, control for conveying and fixing the color developing unit manually taken in near the door 152 to the storage case 151, control for reading the color detection mark 166 of each color developing unit 13 in the storage case 151 on the basis of the output from the color detection sensor and transmitting data to the main body control unit, and control for turning on LEDs 224*a*, 224*b*, and 224*b* for indicating colors of the color developing units on the partition plates 151*a*, 151*b*, and 151*c* of the storage case in a display operation unit 205 (to be described later). The control unit 200 detects abnormality of the motors 171 and 172, and outputs error data to the main body control unit 203. The color code sensor 167 employs a reflection type photointerrupter to read and output data of the color detection mark.

The control unit 200 comprises a known input circuit and a drive circuit for controlling inputs of the sensors, and the solenoids and clutches, an I/F (interface) circuit with the controller 201 for the horizontal motor 172 and the controller 202 for the vertical motor 171, a circuit for performing communication with the main body control unit, an LED drive circuit and a key input circuit for the operation unit 205.

The horizontal motor controller 201 comprises a known PLL circuit for controlling a rotational speed of the horizontal motor 172, and a circuit for driving the horizontal motor 172. The control unit 200 supplies to the horizontal motor controller 201 a signal ON for starting the motor as a control signal, a signal $F_W/B_K$ for determining a rotating direction of the motor, a signal BLK for braking the motor, and a clock signal CLK having a frequency for determining the rotation of the motor. The signal $F_W/B_K$ for determining the rotating direction of the motor corresponds to the Forward and Back directions of the horizontal moving means.

The vertical motor controller 202 receives from the control unit 200 a signal ON for driving the vertical motor 171, a signal U/D for determining the rotating direction of the motor (this signal corresponds to the up and down directions of the moving means Y), and the signals BLK and CLK as in the horizontal motor controller.

Figure 5B:
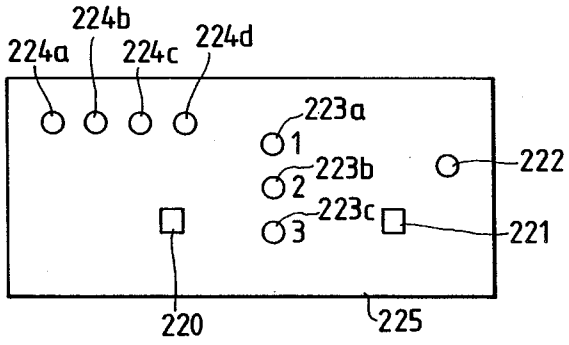
FIG. 5B is a view showing an arrangement of operation keys and indicators of an operation unit of the device for storing the plurality of developing units.

FIGS. 5A and 5B show the operation unit 204 of the image forming apparatus, and the operation unit 205 of the storage device of this embodiment.

Input switches (keys) in the main body operation unit 204 shown in FIG. 5A include a power switch 213, a ten-key pad 205, a clear/stop key 209 for clearing an input numerical value or stopping the image forming operation, a reset key 206 for resetting a mode or the like input at a key input area 214 for inputting a special mode such as a multi-copying mode, or the like, the color selection key 217 for the developing units, a cassette (selection) key 208 for selecting sheet feeding from one of the cassettes 18 and 24 for storing image transfer materials 17, and the like.

The operation unit 204 also serves as a man-machine interface, and is constituted by a liquid-crystal display section 215 for displaying sizes of sheets stored in the cassettes 18 and 24, a copying (image formation) state, and the like, and LEDs 210 (black), **211*a* (red), 211*b* (blue), 211*c* (green), and 211*d*** (brown) each for displaying a color of a selected developing unit.

The operation unit 225 of the storage device shown in FIG. 5B comprises the Select key 220 for selecting the partition section of the storage case, i.e., the storage sections **151*a*, 151*b*, and 151*c*, the Eject key 211 for instructing to convey the developing unit to a position near the door 152 of the storage case 151, Select display LEDs 223*a*, 223*b*, and 223*c* for displaying the storage section designated by the Select key 220, color display LEDs 224*a* (red), 224*b* (blue), 224*c* (green), and 224*d* (brown) for displaying the color of the developing unit in the storage case designated by the Select key 220, and an LED 222** for indicating that the color developing unit is being conveyed.

Figure 7A:
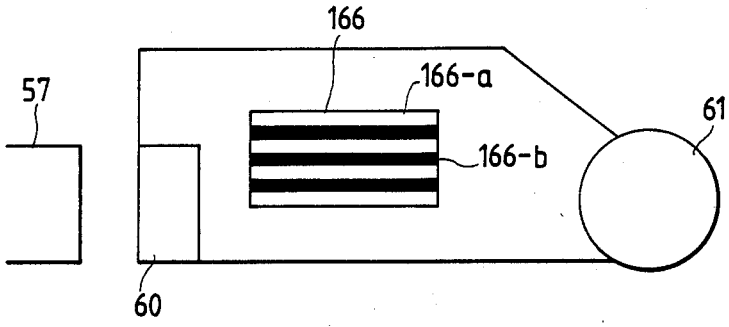
FIG. 7A is a view showing the relationship between a color developing unit and a main body connector.
Figure 7B:
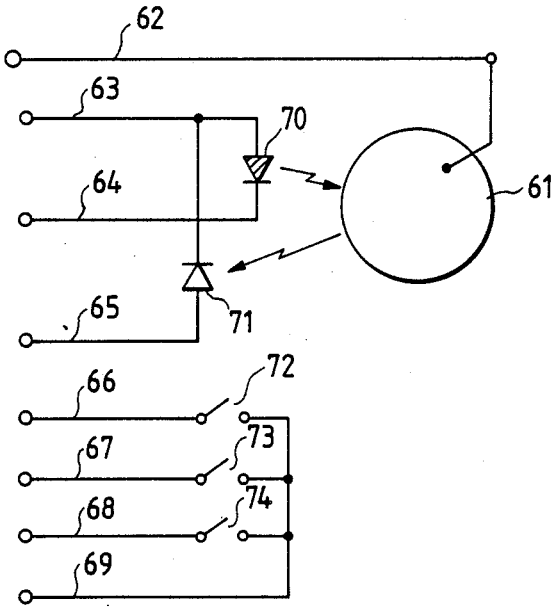
FIG. 7B is a circuit diagram of a connector of the developing unit.

FIG. 7A shows the relationship between the color developing unit 13 and the main body developing unit connector 57, and FIG. 7B shows the circuit of a connector 60 of the developing unit 13.

The connector 60 of the developing unit 13 contacts the connector 57 in the main body to supply color code, toner amount, and developing bias signals to the main body. The color detection mark 166 is attached to the side surface of the color developing unit 13, and is constituted by reflection portions 166-a and non-reflection portions 166-b. As will be described later, the storage case 151 is vertically moved by the moving means Y to read the code of the color detection mark, thereby identifying a color of the developing unit 13. A developing sleeve 61 is used for uniformly supporting a color toner on its surface, applying a developing bias to the toner, and performing the image formation process, as is well known in a known electrostatic image formation process.

FIG. 7B shows a connect signal in the connector 60. A signal line 62 is used for applying the developing bias, which is output from a high-voltage generation power source (not shown). Signal lines 63 to 65 are used for detecting a remaining amount of a toner, i.e., for a reflection sensor constituted by a light-emitting element 70 and a light-receiving element 71. Signal lines 66 to 69 are output signal lines for color code identification, and eight codes can be discriminated by switches 72 to 74.

Figure 17:
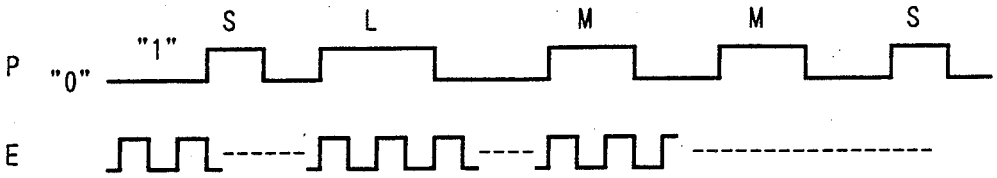
FIG. 17 is a timing chart of a color detection output signal.

A detection operation of the color detection mark 166 will be described below with reference to FIG. 17. A signal shown in FIG. 17 is an output signal P from the color detection sensor 167. The color detection sensor 167 comprises a known reflection type sensor, and generates an output signal "1" for the reflection mark and an output signal "0" for the non-reflection mark. FIG. 17 also shows a pulse output (encoder output) E proportional to the rotational speed of the vertical motor 171.

Figure 18:
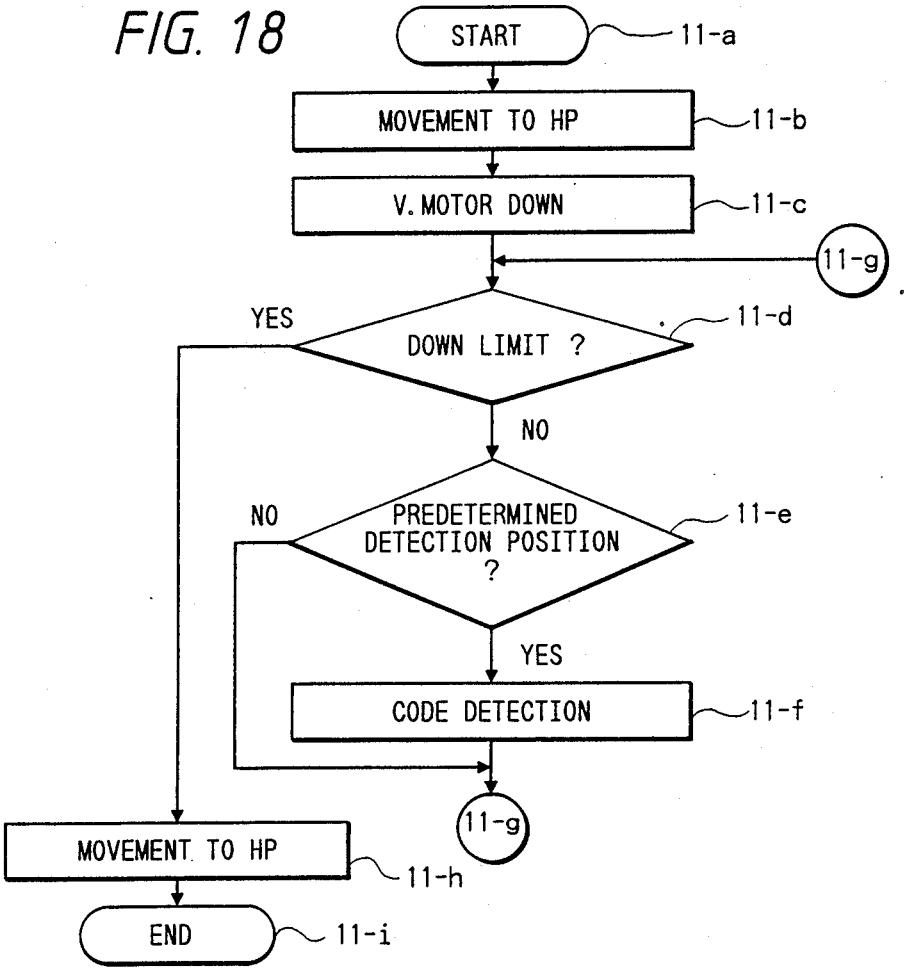
FIG. 18 is a flow chart showing a color detection operation.

FIG. 18 is a flow chart for detecting a color of the developing unit by code analysis of the output signal P from the color detection sensor. In step 11-b, the storage case 151 is vertically moved to and stopped at the predetermined home position. In step 11-c, the storage case 151 is moved in the down direction until the partition plate **151*a* of the developing unit storage case faces the developing unit taking out/in portion 55*b*, i.e., the main body developing unit taking in port 55*a*. If a down limit is detected in step 11-d, the storage case 151 is moved to the home position in step 11-h, thus completing an operation. When a predetermined encoder pulse count (predetermined position) is reached in step 11-e, the width of the color detection output signal "1" is counted by the encoder pulse E to detect marks "S", "L", and "M" shown in FIG. 17. On the basis of the marks "S", "L", and "M", the color codes and the number of color developing units 13** are stored.

Figure 19:
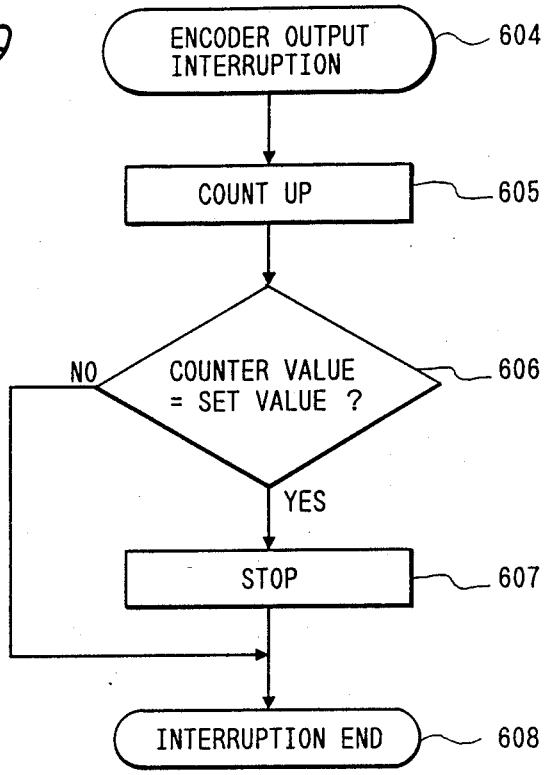
FIGS. 19, 20, and 21 are flow charts showing an operation for positioning a developing unit storage portion.

In this embodiment, a position detected by the vertical home position sensor 159 shown in FIGS. 2 and 4 is used as the home position. As a moving distance measuring means, an output from the encoder E attached to the vertical motor 171 shown in FIGS. 1 and 4 is used. A positioning sequence of a desired storage section of the storage case 151 will be described below with reference to FIG. 19.

The storage case 151 is located at the home position in a standby state. When a storage section is selected, the control unit 200 sets a counter value corresponding to the selected storage section, initializes the counter, and starts the vertical motor 171 in a rotational direction corresponding to the down direction. Every time the encoder output E of the vertical motor 171 is input, the control unit 200 executes an interruption sequence (step 604), counts up the counter value (step 605), compares the counter value with a set value (step 606), and stops the vertical motor 171 when these values are equal to each other (step 607).

In this embodiment, a stop position is determined by only an operation in one direction from the home position, and the count of the encoder output E is initialized before an operation. Therefore, accumulation of errors caused by counting errors of a counter can be eliminated.

Figure 20:
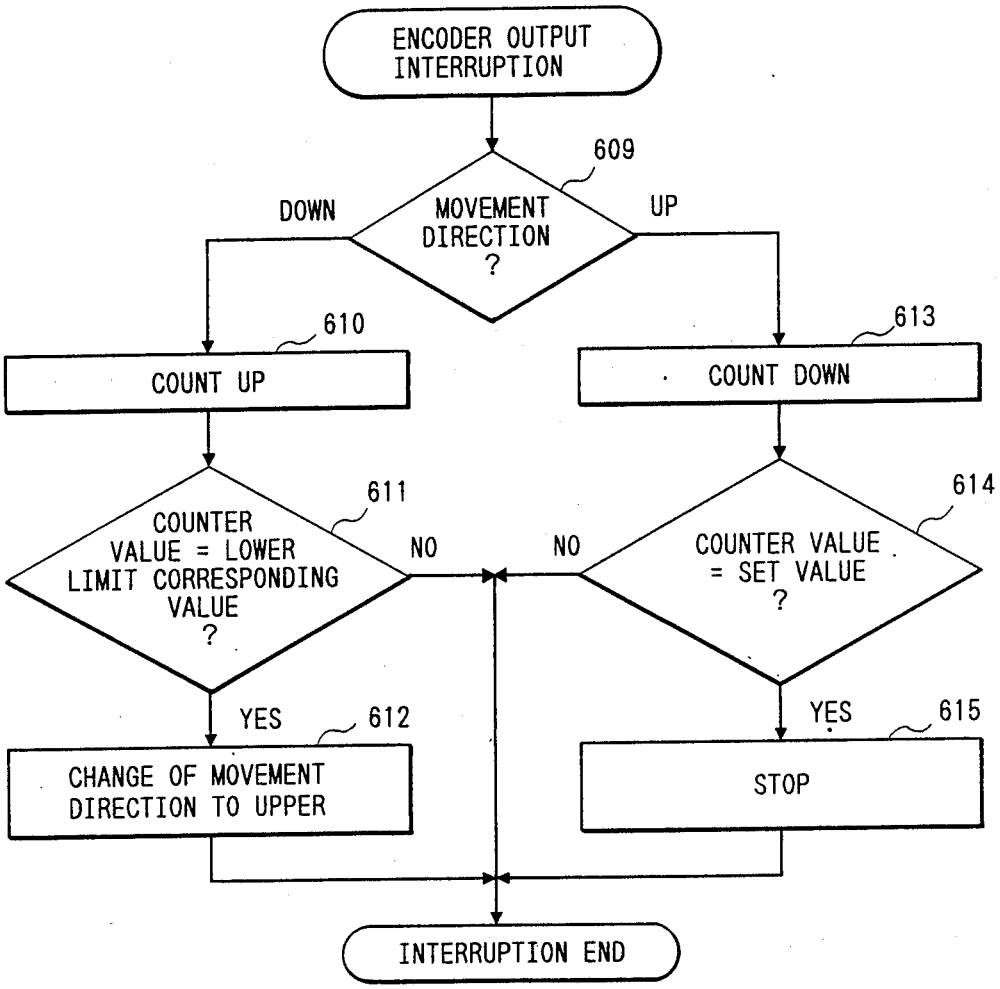

In the above embodiment, the counter value is monitored while the storage case 151 is moved downward from the home position, and the stop position is determined. With this method, when a motor speed is controlled by a braking amount, if the number of developing units is large, the inertial force is increased, and quick stop in response to a stop signal cannot be achieved. A method of setting an output timing of a stop signal in an upward movement state while monitoring a counter value will be described below with reference to FIG. 20. When a desired storage section is selected, the control unit 200 sets a lower limit correspondence value suitable for moving the uppermost storage section 151*a* of the storage case 151 to a position below the developing unit taking out/in portion 55*b*. The counter is initialized, and the vertical motor 171 is started in a rotating direction corresponding to the down direction. Every time the encoder output E is input, the control unit 200 starts an interruption sequence, and detects the moving direction of the storage case 151 (step 610). When the moving direction corresponds to the down direction, the control unit increments the counter value (step 610). When the counter value becomes equal to a set value (step 611), the control unit causes the vertical motor 171 to rotate in the reverse direction (step 612), and decrements the counter value in response to every encoder output in turn (step 613). When the counter value becomes equal to a set value corresponding to the selected storage section (step 614), the control unit stops the vertical motor 171 (step 615). In this embodiment, the weights of the developing units 13, the storage case 151, and the like act in a direction to stop the vertical motor 171 when the storage case is stopped. Thus, stop precision of the storage section 151*a*, and the like with respect to the desired position, i.e., the developing unit taking out/in portion 55*b* can be improved.

Figure 21:
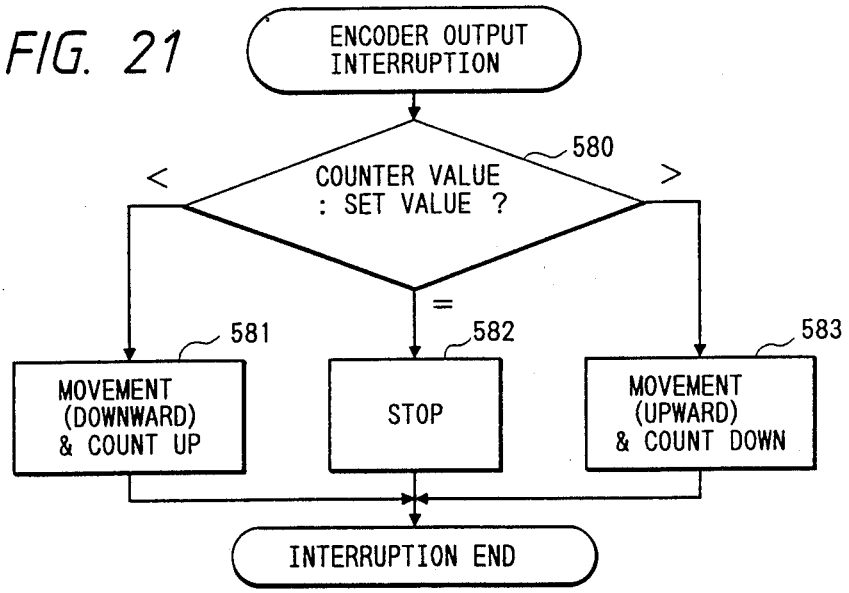

In the following embodiment, a stop timing of the vertical motor 171 is not restricted by moving directions. If only one developing unit is exchanged with the main body, the stop position need only be determined once. However, when the developing units 13 are exchanged, as shown in FIG. 11, after one developing unit 13 is returned from the main body to the storage case 151, the storage case must be temporarily returned to the home position. A method of allowing continuous movement of the storage case without returning it to the home position when the sequence for selecting the storage sections 151*a* to 151*c* storing the developing units 13 is continuously executed will be described below with reference to FIG. 21.

A counter value is compared with a set value in response to each encoder output to determine an up or down direction (step 580). When the counter value is smaller then the set value, the storage case is moved in the down direction, and the counter is incremented (step 581). When the counter value is larger than the set value, the storage case is moved in the up direction, and the counter value is decremented (step 583). When the counter value coincides with the set value, the movement is stopped (step 582). In a sequence excluding interruption, control in step 533 in FIG. 11 can be omitted.

With this embodiment, a quick developing unit exchange sequence can be realized. In this embodiment, the storage case is stopped at the home position after all the operations are completed, thus eliminating accumulation of errors.

Braking amount control will be described below.

Figure 22:
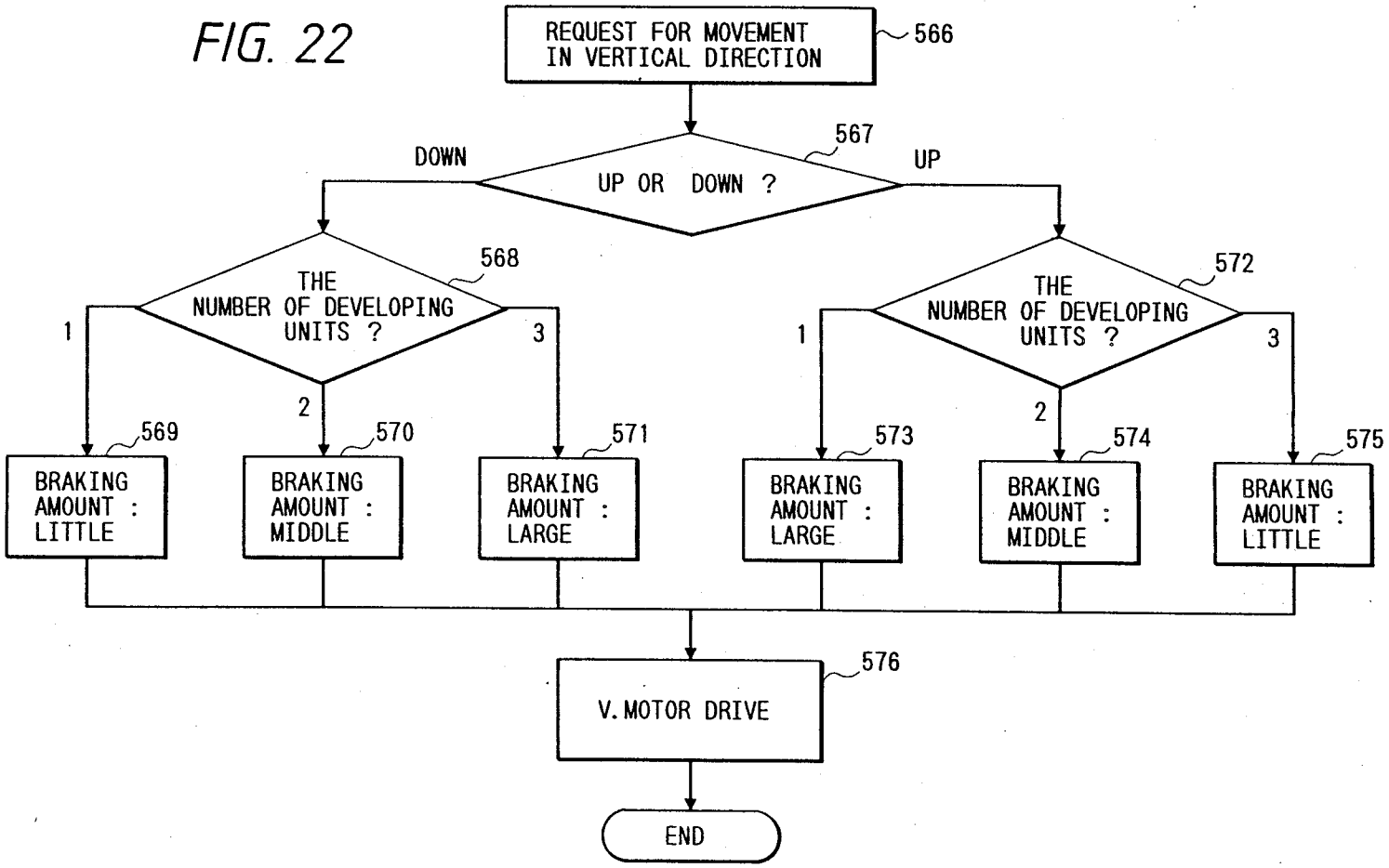
FIG. 22 is a flow chart showing a braking amount control operation.

In the storage device shown in FIG. 1, as the number of developing units in the storage case 151 is increased, a load upon vertical movement largely varies. In the embodiment shown in FIG. 19, the signal ON (H/L) and the signal BLK (pwm control) are supplied to the vertical motor controller 202 shown in FIG. 4 to control the movement of the motor 171. Therefore, upon comparison between a case with one developing unit and a case with three developing units, when the storage case is moved in the up direction, a downward load of the case with the three developing units is larger than that of the other case. In order to move the storage case at an equal speed, the braking amount must be decreased. When the case with one developing unit is braked by the same amount as in the case with three developing units, since the downward load is smaller, stop precision is adversely influenced. The braking amount is changed like "large", "middle", and "little", as shown in FIG. 22 in accordance with the number (1 to 3) of the developing units, so that control at a stable speed free from the influence of the number of developing units can be achieved, and positioning can be precisely performed (steps 572 to 575). When the storage case is moved in the down direction, the situation is the opposite. Therefore, the braking amount must be changed according to the number of developing units in an opposite manner (steps 568 to 571).

Figure 13:
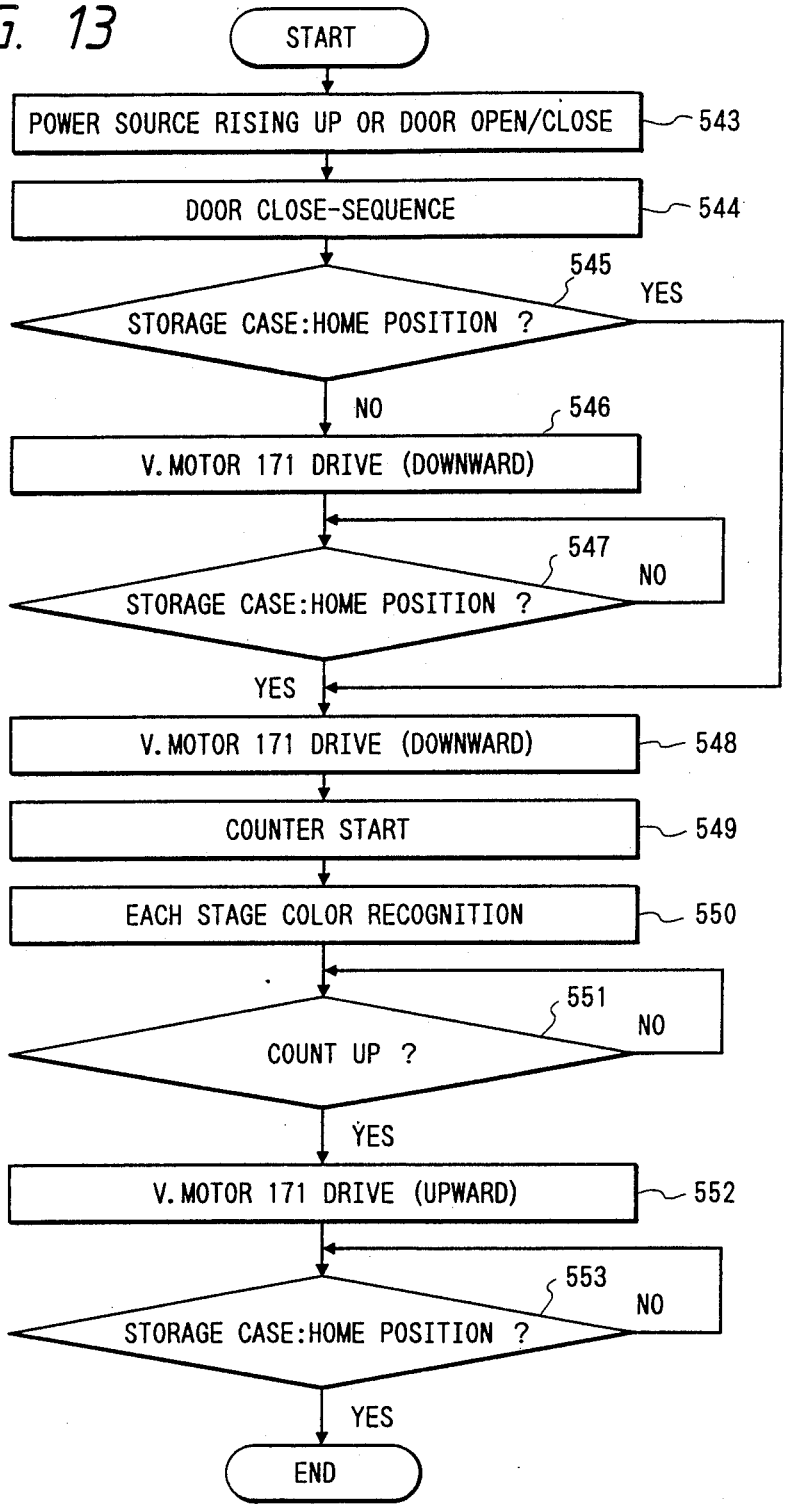
FIG. 13 is a flow chart showing an initialization sequence.

Note that the presence/absence of the developing unit in each storage section is checked in step 550 shown in FIG. 13. More specifically, it is determined that a storage section which cannot be color-detected upon color recognition is empty.

With the above arrangement, positioning of the storage section of the storage case can be precisely performed by a relatively simple structure.

Note that the present invention is not limited to the above embodiment, and various changes and modifications may be made within the spirit and scope of the appended claims.

What is claimed is:

1. A developing unit storage device comprising:

a plurality of storage means for storing developing units;

a taking in portion for taking in the developing unit from a corresponding one of said storage means into an image forming apparatus;

first moving means for moving the developing unit in a first direction between said storage means and said image forming apparatus;

second moving means for moving said storage means in a second direction different from the first direction so that a desired one of said storage means is adjusted to said taking in portion; and control means for inhibiting said first and second moving means from operating at the same time.

2. A device according to claim 1, wherein when a moving request in the first direction is input, said control means operates said first moving means under the condition that said second moving means is not in operation.

3. A device according to claim 1, wherein when a moving request in the second direction is input, said control means operates said second moving means under the condition that said first moving means is not in operation.

4. A device according to claim 1, wherein said control means comprises switching means for, when a drive signal for one of said first and second moving means is output, disabling a drive signal to the other.

5. A device according to claim 1, further comprising detection means for detecting types of said developing units stored in said plurality of storage devices, and wherein said control means controls said second moving means on the basis of an output from said detection means so as to adjust a desired one of said storage means to said taking in portion.

6. A device according to claim 5, wherein said detection means detects a developing color of the developing unit.

7. A device according to any one of claims 1 to 6, wherein said first moving means moves the developing unit in a horizontal direction.

8. A device according to any one of claims 1 to 6, wherein said second moving means moves said storage means in a vertical direction.

9. A device according to any one of claims 1 to 6, wherein said second moving means moves said plurality of storage means together.

10. A developing unit storage device comprising:

a plurality of storage means for storing developing units;

a carrying out portion for carrying out the developing unit from an image forming apparatus with respect to a corresponding one of said storage means;

first moving means for moving the developing unit in a first direction between said storage means and said image forming apparatus;

second moving means for moving said storage means in a second direction different from the first direction so that a desired one of said storage means is adjusted to said carrying out portion; and control means for inhibiting said first and second moving means from operating at the same time.

11. A device according to claim 10, wherein when a moving request in the first direction is input, said control means operates said first moving means under the condition that said second moving means is not in operation.

12. A device according to claim 10, wherein when a moving request in the second direction is input, said control means operates said second moving means under the condition that said first moving means is not in operation.

13. A device according to claim 10, wherein said control means comprises switching means for, when a drive signal for one of said first and second moving means is output, disabling a drive signal to the other.

14. A device according to claim 10, further comprising detection means for detecting the presence/absence of said developing units stored in said plurality of storage devices, and wherein when the developing unit is carried out from said image forming apparatus to said storage means, said control means controls said second moving means on the basis of an output from said detection means so as to adjust an empty one of said storage means to said carrying out portion.

15. A device according to any one of claims 10 to 14, wherein said first moving means moves the developing unit in a horizontal direction.

16. A device according to any one of claims 10 to 14, wherein said second moving means moves said storage means in a vertical direction.

17. A device according to any one of claims 10 to 14, wherein said second moving means moves said plurality of storage means together.

18. An image forming system comprising:

an image forming apparatus including electrostatic latent image forming means for forming an electrostatic latent image on a photosensitive body, transfer means for transferring a developed image corresponding to the electrostatic latent image on said photosensitive body onto a recording material, and a taking out/in portion for taking out/in developing means for developing the electrostatic latent image on said photosensitive body; and a developing unit storage device having a plurality of storage means for storing said developing means, a taking in/carrying out portion, facing said taking out/in portion, for taking in said developing means from said storage means into said image forming apparatus and carrying out said developing means from said image forming apparatus to said storage means;

first moving means for moving the developing unit in a first direction between said storage means and said image forming apparatus, second moving means for moving said storage means in a second direction different from the first direction so that a desired one of said storage means is adjusted to said taking in/carrying out portion, and control means for inhibiting said first and second moving means from operating at the same time.

19. A developing unit storage device comprising:

a plurality of storage means for storing developing units;

a taking out/in portion for carrying out or taking in the developing unit from said storage means to an image forming apparatus or from said image forming apparatus to said storage means;

moving means for moving said storage means relative to said taking out/in portion; and control means for moving said storage means from a reference position and controlling an operation of said moving means in accordance with a moving distance of said storage means from the reference position.

20. A device according to claim 19, wherein said moving means moves said storage means in up and down directions, and when one of said storage means is adjusted to said taking out/in portion, said control means controls said moving means so as to stop said storage means in an upward moving state.

21. A device according to claim 19 or 20, wherein said control means comprises output means for outputting a pulse signal synchronous with an operation of said moving means, and counter means for counting the pulse signal output from said output means, and controls the operation of said moving means in accordance with a count value of said counter means.

22. A device according to claim 19 or 20 wherein said moving means moves said plurality of storage means together.

23. A developing unit storage device comprising:

a plurality of storage means for storing developing units;

a taking out/in portion for carrying out or taking in the developing unit from said storage means to an image forming apparatus or from said image forming apparatus to said storage means;

moving means for moving said storage means relative to said taking out/in portion;

braking means for performing a braking operation to stop said moving means; and control means for controlling a braking amount of said braking means in accordance with the number of developing units stored in said plurality of storage means.

24. A device according to claim 23, wherein said moving means moves said plurality of storage means together.

25. A device according to claim 23, wherein said control means increases the braking amount as the number of developing units stored in said plurality of storage means is increased.

26. A device according to claim 23 or 25, wherein said control means comprises detection means for detecting the presence/absence of said developing units in said plurality of storage means, and detects the number of developing units in accordance with an output from said detection means.

27. A device according to claim 23, wherein said moving means moves said plurality of storage means in up and down directions, and said control means controls the braking amount in accordance with a moving direction of said moving means.

28. A device according to claim 27, wherein when the moving direction corresponds to the down direction, said control means increases the braking amount as the number of developing units stored in said plurality of storage means is increased.

29. A device according to claim 27 or 28, wherein when the moving direction corresponds to the up direction, said control means decreases the braking amount as the number of developing units stored in said plurality of storage means is increased.

30. A developing unit storage device comprising:

storage means for storing developing units;

a taking out/in portion for carrying out or taking in the developing unit from said storage means to an image forming apparatus or from said image forming apparatus to said storage means;

moving means for moving said storage means in an up or down direction relative to said taking out/in portion;

braking means for performing a braking operation to stop said moving means; and control means for determining a braking amount of said braking means in different modes in accordance with the moving direction of said moving means.

31. A device according to claim 30, wherein said storage means can store a plurality of developing units.

32. A device according to claim 31, wherein said control means determines the braking amount so that the number of developing units stored in said storage means and the braking amount have opposite relationships in accordance with whether the moving direction of said moving means corresponds to the up or down direction.

33. A device according to claim 32, wherein when the moving direction corresponds to the down direction, said control means increases the braking amount as the number of developing units stored in said plurality of storage means is increased.

34. A device according to claim 32 or 33, wherein when the moving direction corresponds to the up direction, said control means decreases the braking amount as the number of developing units stored in said plurality of storage means is increased.

* * * * *